US012808268B2

(12) United States Patent
Magnuson

(10) Patent No.: US 12,808,268 B2
(45) Date of Patent: Nov. 24, 2026

(54) WRENCH WITH SELF-INTENSIFIER

(71) Applicant: Nabors Drilling Technologies USA, Inc., Houston, TX (US)

(72) Inventor: Christopher Magnuson, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 330 days.

(21) Appl. No.: 18/585,819

(22) Filed: Feb. 23, 2024

(65) Prior Publication Data

US 2024/0287858 A1 Aug. 29, 2024

Related U.S. Application Data

(60) Provisional application No. 63/487,131, filed on Feb. 27, 2023.

(51) Int. Cl.
*E21B 19/16* (2006.01)

(52) U.S. Cl.
CPC ..... *E21B 19/163* (2013.01)

(58) Field of Classification Search
CPC ..... E21B 19/16; E21B 19/161; E21B 19/163; E21B 19/164; E21B 19/165; E21B 19/166
See application file for complete search history.

(56) References Cited

U.S. PATENT DOCUMENTS 2,705,614 A 4/1955 McKibben et al.
4,403,897 A 9/1983 Willis
5,099,725 A 3/1992 Bouligny, Jr. et al.
5,537,900 A 7/1996 Schaar
6,050,156 A * 4/2000 Buck ..... E21B 19/164 81/57.33
6,116,345 A 9/2000 Fontana et al.
6,263,763 B1 7/2001 Fiegel, Jr. et al.
(Continued)

FOREIGN PATENT DOCUMENTS

CA 2726637 A1 12/2009
CA 2773295 C 5/2015
(Continued)

OTHER PUBLICATIONS

International Search Report and Written Opinion for PCT/US2024/017084, mailed Jul. 2, 2024, 11 pages.

*Primary Examiner* — David B. Thomas
(74) *Attorney, Agent, or Firm* — Thorpe North & Western, LLC

(57) ABSTRACT

A system including a wrench with multiple actuators configured to engage a tubular joint when the multiple actuators are extended, and a first actuator of the multiple actuators being configured to intensify an engagement force applied to the portion of the tubular joint in response to slippage between at least one of the multiple actuators and the portion of the tubular joint. A method for torquing or untorquing a tool joint an include engaging a portion of a tubular joint with a plurality of actuators, applying a first engagement force to the portion of the tubular joint via a first actuator of the plurality of actuators, and intensifying the first engagement force in response to slippage between at least one of the plurality of actuators and the portion of the tubular joint.

20 Claims, 11 Drawing Sheets

(56) References Cited

U.S. PATENT DOCUMENTS 6,684,737 B1 * 2/2004 Schulze-Beckinghausen ..... E21B 19/164 81/57.33
6,745,646 B1 * 6/2004 Pietras ..... E21B 19/164 81/57.21
6,971,283 B2 12/2005 Belik
7,062,991 B1 6/2006 West et al.
7,121,166 B2 10/2006 Drzewiecki
7,188,547 B1 3/2007 West et al.
7,281,451 B2 * 10/2007 Schulze Beckinghausen ..... E21B 19/164 81/57.16
7,313,986 B2 1/2008 West et al.
7,370,707 B2 * 5/2008 McDaniel ..... E21B 19/004 166/380
7,387,050 B2 * 6/2008 Slettedal ..... E21B 19/163 81/57.16
7,464,612 B2 12/2008 Manella et al.
7,748,297 B2 7/2010 Belik
8,109,179 B2 * 2/2012 Richardson ..... E21B 19/164 81/22
8,235,104 B1 8/2012 Sigmar et al.
8,424,419 B2 4/2013 Connell
8,474,806 B2 7/2013 Orgeron
8,601,910 B2 12/2013 Begnaud
8,733,213 B2 5/2014 Taggart
8,777,199 B2 7/2014 Webb
8,863,621 B2 * 10/2014 Richardson ..... E21B 19/164 81/57.24
9,328,571 B2 5/2016 Taggart
9,528,332 B2 12/2016 Richardson
9,988,863 B2 * 6/2018 Gaskin ..... E21B 19/15
10,006,260 B2 6/2018 Webre et al.
10,247,279 B2 4/2019 Scekic et al.
10,309,169 B2 6/2019 Scekic et al.
10,329,857 B2 6/2019 Hunter
10,480,264 B2 11/2019 Scekic et al.
10,538,976 B2 1/2020 Scekic et al.
10,550,651 B2 * 2/2020 Webb ..... E21B 19/163
10,557,321 B2 2/2020 Scekic et al.
10,648,254 B2 5/2020 Meuth
10,689,925 B2 6/2020 Angelle et al.
10,697,260 B2 * 6/2020 Henriksen ..... E21B 19/161
10,718,171 B2 7/2020 McCorriston et al.
10,767,425 B2 9/2020 Meuth et al.
10,808,469 B2 10/2020 Vo
10,808,472 B2 * 10/2020 Helms ..... E21B 19/165
10,808,474 B2 * 10/2020 Ruehmann ..... E21B 19/166
11,028,888 B2 6/2021 Scekic et al.
11,118,429 B2 * 9/2021 Wiedecke ..... E21B 19/161
11,162,310 B2 * 11/2021 Helms ..... E21B 19/16
11,293,269 B2 * 4/2022 Wiedecke ..... E21B 41/00
11,492,857 B2 * 11/2022 Webb ..... E21B 19/165
11,549,320 B2 1/2023 Taggart
11,608,694 B2 3/2023 McCorriston et al.
11,719,044 B2 8/2023 Mikalsen
11,846,146 B2 12/2023 Van Duivendijk
11,892,105 B2 * 2/2024 Sabatier ..... F16L 15/002
11,993,988 B2 5/2024 Magnuson
2003/0205112 A1 11/2003 Hawkins, III
2005/0241441 A1 11/2005 Drzewiecki
2008/0250902 A1 * 10/2008 Slettedal ..... E21B 19/164 81/57.16
2009/0211405 A1 * 8/2009 Hunter ..... E21B 19/163 81/57.2
2015/0090463 A1 4/2015 Gupta et al.
2015/0107420 A1 * 4/2015 Webb ..... E21B 19/165 29/434
2016/0186509 A1 6/2016 Steffenhagen et al.
2016/0290073 A1 10/2016 Zheng et al.
2018/0347295 A1 12/2018 Vo
2018/0347296 A1 12/2018 Vo
2019/0316428 A1 10/2019 Meuth et al.
2020/0047336 A1 2/2020 Savini et al.
2020/0063506 A1 2/2020 Helms et al.
2020/0063507 A1 2/2020 Thiemann
2020/0378198 A1 * 12/2020 Hill ..... E21B 19/07
2021/0032944 A1 * 2/2021 Helms ..... E21B 45/00
2021/0102454 A1 * 4/2021 Jorud ..... G06Q 50/265
2021/0293091 A1 9/2021 Mikalsen et al.
2021/0363838 A1 11/2021 Magnuson
2021/0397154 A1 * 12/2021 Thakur ..... G05B 19/4065
2022/0090454 A1 3/2022 Taggart et al.
2023/0203898 A1 6/2023 McCorriston et al.

FOREIGN PATENT DOCUMENTS

EP 2851504 B1 3/2015
EP 3141690 B1 3/2017
WO 2017100913 A1 6/2017

* cited by examiner

WRENCH WITH SELF-INTENSIFIER

CROSS-REFERENCE TO RELATED APPLICATION(S)

This application claims priority under 35 U.S.C. § 119(e) to U.S. Provisional Application No. 63/487,131, entitled "WRENCH WITH SELF-INTENSIFIER," by Christopher MAGNUSON, filed Feb. 27, 2023, which is assigned to the current assignee hereof and incorporated herein by reference in its entirety.

FIELD OF THE DISCLOSURE

The present invention relates, in general, to the field of drilling and processing of wells. More particularly, present embodiments relate to a system and method for making or breaking joint connections in a tubular string during subterranean operations.

BACKGROUND

Iron Roughnecks as well as other tubular manipulators have devices for gripping, holding, spinning, or torquing tubulars during subterranean operations (e.g., drilling, treating, completing, producing, or abandoning a wellbore). These operations may require assembling or disassembling a tubular string that extends into the wellbore from a rig floor. As the tubular string is being extended into the wellbore, successive tubulars are connected to the top end of the tubular string to lengthen it and extend it further into the wellbore. As the tubular string is being disassembled into individual tubulars, the process is reversed with the tubular string being successively pulled from the wellbore an appropriate distance to remove the next tubular by breaking loss a joint.

Each connection forms a joint, where the joint can include a pin end of a tubular threaded into a box end of the tubular string. To prevent failures of the joint as the tubular string is being used, there are industry standard torque requirements that should be applied to each joint as the joint is being made up to ensure proper operation of the tubular string. If these torque requirements are not met, then the joint may prematurely separate causing failure of the joint and thus failure of the tubular string. Larger diameters tubulars may require up to 120,000 ft-lbs (162.7 Kn-m) of force applied to the joint to torque the joint to the specified torque requirements. This massive amount of force can be applied by torque wrenches in the tubular handling equipment such as iron roughnecks, make-up/break-up tongs, etc. Iron roughnecks are generally used to assemble/disassemble the tubular string at well center which can be considered an "online" operation since its operation directly impacts rig time. The make-up/break-up tongs are generally used "offline" to build tubular stands (e.g., connect two or more tubulars together to form a tubular stand) which can be stored in horizontal or vertical storage in preparation for supporting the subterranean operations.

The tubular handling equipment required to deliver up to 120K ft-lbs (162.7 Kn-m) of force tends to be very large and can pose design challenges for equipment, such as iron roughnecks, that may be manipulated by a robotic arm pivotably mounted to a rig floor. The weight and size of the torque wrenches to support the specified torque requirements is substantial.

Therefore, improvements of tubular handling equipment are continually needed, and particularly improvements for the weight and size of torque wrenches used in support of subterranean operations.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a system for torquing or untorquing a tool joint. The system also includes a wrench with multiple actuators configured to engage a portion of a tubular joint when the multiple actuators are extended, and a first actuator of the multiple actuators being configured to intensify a first engagement force applied to the portion of the tubular joint in response to slippage between at least one of the multiple actuators and the portion of the tubular joint.

One general aspect includes a system for torquing or untorquing a tool joint. The system also includes a wrench with multiple actuators configured to engage a tubular joint when the multiple actuators are extended, the multiple actuators may include a first actuator, a second actuator, and a third actuator; a pressure equalizer that substantially equalizes a first pressure applied to the first actuator to a second pressure applied to the second actuator, and a flow control device that is configured to substantially equally increase the first pressure and the second pressure when either one of the first actuator or the second actuator slips relative to the tubular joint.

One general aspect includes a system for torquing or untorquing a tool joint. The system also includes a torque wrench with multiple actuators configured to engage a tubular joint when the multiple actuators are extended, the torque wrench being configured to rotate at least a portion of the tubular joint about a center axis when engaged with the portion of the tubular joint, and at least one of the multiple actuators being configured to intensify an engagement force applied to the portion of the tubular joint in response to slippage between at least one of the multiple actuators and the portion of the tubular joint.

One general aspect includes a system for torquing or untorquing a tool joint. The system also includes a torque wrench with a first set of actuators configured to engage a pin end of a tubular joint when the first set of actuators are extended, the torque wrench being configured to rotate the pin end about a center axis of the torque wrench when engaged with the pin end; and a backup tong with a second set of actuators configured to engage a box end of the tubular joint when the second set of actuators are extended, the backup tong being configured to prevent rotation of the box end about the center axis when the second set of actuators are engaged with the box end, where a first actuator of the second set of actuators is configured to intensify a first engagement force applied to the box end when one of the second set of actuators slips relative to the box end.

One general aspect includes a method for torquing or untorquing a tool joint. The method also includes engaging a portion of a tubular joint with a plurality of actuators; applying a first engagement force to the portion of the tubular joint via a first actuator of the plurality of actuators, and intensifying the first engagement force in response to slippage between at least one of the plurality of actuators and the portion of the tubular joint. Other embodiments of this aspect include corresponding computer systems, apparatus, and computer programs recorded on one or more computer storage devices, each configured to perform the actions of the methods.

One general aspect includes a system for torquing or untorquing a tool joint. The system also includes a wrench with multiple actuators configured to engage a portion of a tubular joint when the multiple actuators are extended, and a first actuator of the multiple actuators being configured to intensify a first engagement force applied to the portion of the tubular joint in response to slippage between at least one of the multiple actuators and the portion of the tubular joint.

One general aspect includes a system for torquing or untorquing a tool joint. The system also includes a torque wrench with multiple actuators configured to engage a tubular joint when the multiple actuators are extended, the torque wrench being configured to rotate at least a portion of the tubular joint about a center axis of the torque wrench when the multiple actuators are engaged with the portion of the tubular joint, and a first actuator of the multiple actuators being configured to apply a first engagement force to the portion of the tubular joint when it is extended and apply a second engagement force to the portion of the tubular joint when at least one of the multiple actuators slips relative to the portion of the tubular joint.

One general aspect includes a system for torquing or untorquing a tool joint. The system also includes a torque wrench with multiple actuators circumferentially spaced around a center axis of the torque wrench, where the multiple actuators are configured to engage a tubular joint when the multiple actuators are extended, where the torque wrench is configured to rotate about the center axis and rotate at least a portion of the tubular joint about the center axis, and where at least one of the multiple actuators is configured to intensify an engagement force applied to the portion of the tubular joint when at least one of the multiple actuators slips relative to the portion of the tubular joint.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", "generally, or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
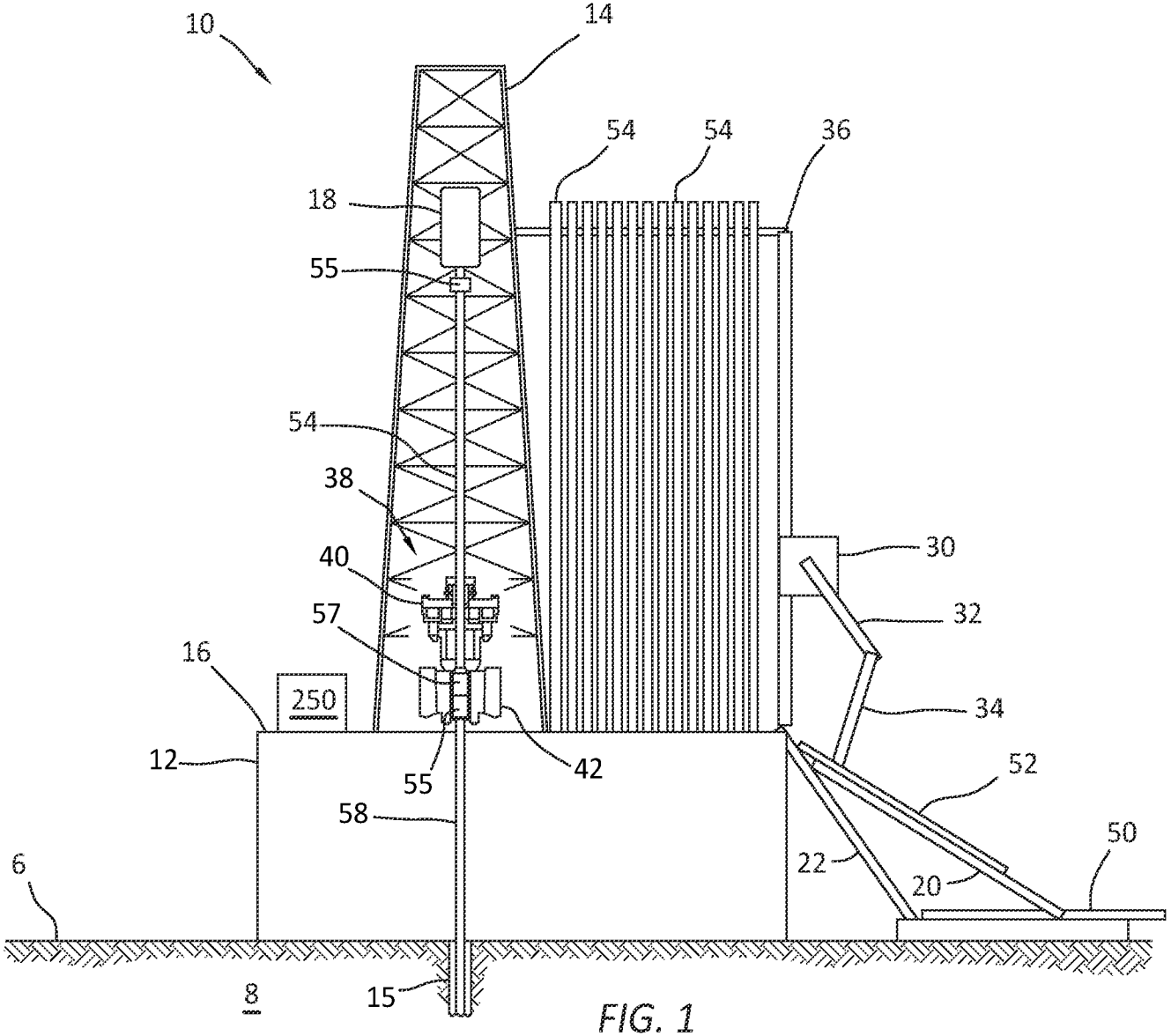
FIG. 1 is a representative simplified front view of a rig being utilized for a subterranean operation, in accordance with certain embodiments.

As used herein, "tubular" refers to an elongated cylindrical tube and can include any of the tubulars manipulated around a rig, such as tubular segments, tubular stands, tubulars, and tubular string, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

FIG. 1 is a representative simplified front view of a rig 10 being utilized for a subterranean operation (e.g., tripping in or out a tubular string to or from a wellbore), in accordance with certain embodiments. Rig 10 can include a platform 12 with a rig floor 16 and a derrick 14 extending up from the rig floor 16. The derrick 14 can provide support for hoisting the top drive 18 as needed to manipulate tubulars. A catwalk 20 and V-door ramp 22 can be used to transfer horizontally stored tubular segments 50 to the rig floor 16. Tubular segment 52 can be one of the horizontally stored tubular segments 50 that is being transferred to the rig floor 16 via the catwalk 20. A pipe handler 30 with articulating arms 32, 34 can be used to grab the tubular segment 52 from the catwalk 20 and transfer the tubular segment 52 to the top drive 18, the fingerboard 36, the wellbore 15, etc. However, it is not required that a pipe handler 30 be used on rig 10. The top drive 18 can transfer tubulars directly between the catwalk 20 and a well center on the rig floor (e.g., using an elevator coupled to the top drive). As used herein, "tubular" refers to an elongated cylindrical tube and can include any of the tubulars manipulated around the rig 10, such as tubular segments 50, 52, tubular stands, tubulars 54, and tubular string 58, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

The tubular string 58 can extend into the wellbore 15, with the wellbore 15 extending through the surface 6 into the subterranean formation 8. When tripping the tubular string 58 into the wellbore 15, tubulars 54 are sequentially added to the tubular string 58 to extend the length of the tubular string 58 into the earthen formation 8. FIG. 1 shows a land-based rig. However, it should be understood that the principles of this disclosure are equally applicable to off-shore rigs where "off-shore" refers to a rig with water between the rig floor and the earth surface 6. When tripping the tubular string 58 out of the wellbore 15, tubulars 54 are sequentially removed from the tubular string 58 to reduce the length of the tubular string 58 in the wellbore 15.

When tripping the tubular string 58 into the wellbore 15, the pipe handler 30 can be used to deliver the tubulars 54 to a well center on the rig floor 16 in a vertical orientation and hand the tubulars 54 off to an iron roughneck 38 or a top drive 18. When tripping the tubular string 58 out of the wellbore 15, the pipe handler 30 can be used to remove the tubulars 54 from the well center in a vertical orientation and receive the tubulars 54 from the iron roughneck 38 or a top drive 18. The iron roughneck 38 can make a threaded connection between a tubular 54 being added and the tubular string 58. A spinner assembly 40 can engage a body of the tubular 54 to spin a pin end 57 of the tubular 54 into a threaded box end 55 of the tubular string 58, thereby threading the tubular 54 into the tubular string 58. The torque wrench assembly 42 can provide a desired torque to the threaded connection, thereby completing the connection. This process can be reversed when the tubulars 54 are being removed from the tubular string 58.

A rig controller 250 can be used to control the rig 10 operations including controlling various rig equipment, such as the pipe handler 30, the top drive 18 and the iron roughneck 38. The rig controller 250 can control the rig equipment autonomously (e.g., without periodic operator interaction,), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation). A portion of the rig controller 250 can also be distributed around the rig 10, such as having a portion of the rig controller 250 in the pipe handler 30, in the iron roughneck 38, or around the rig 10.

Figure 2:
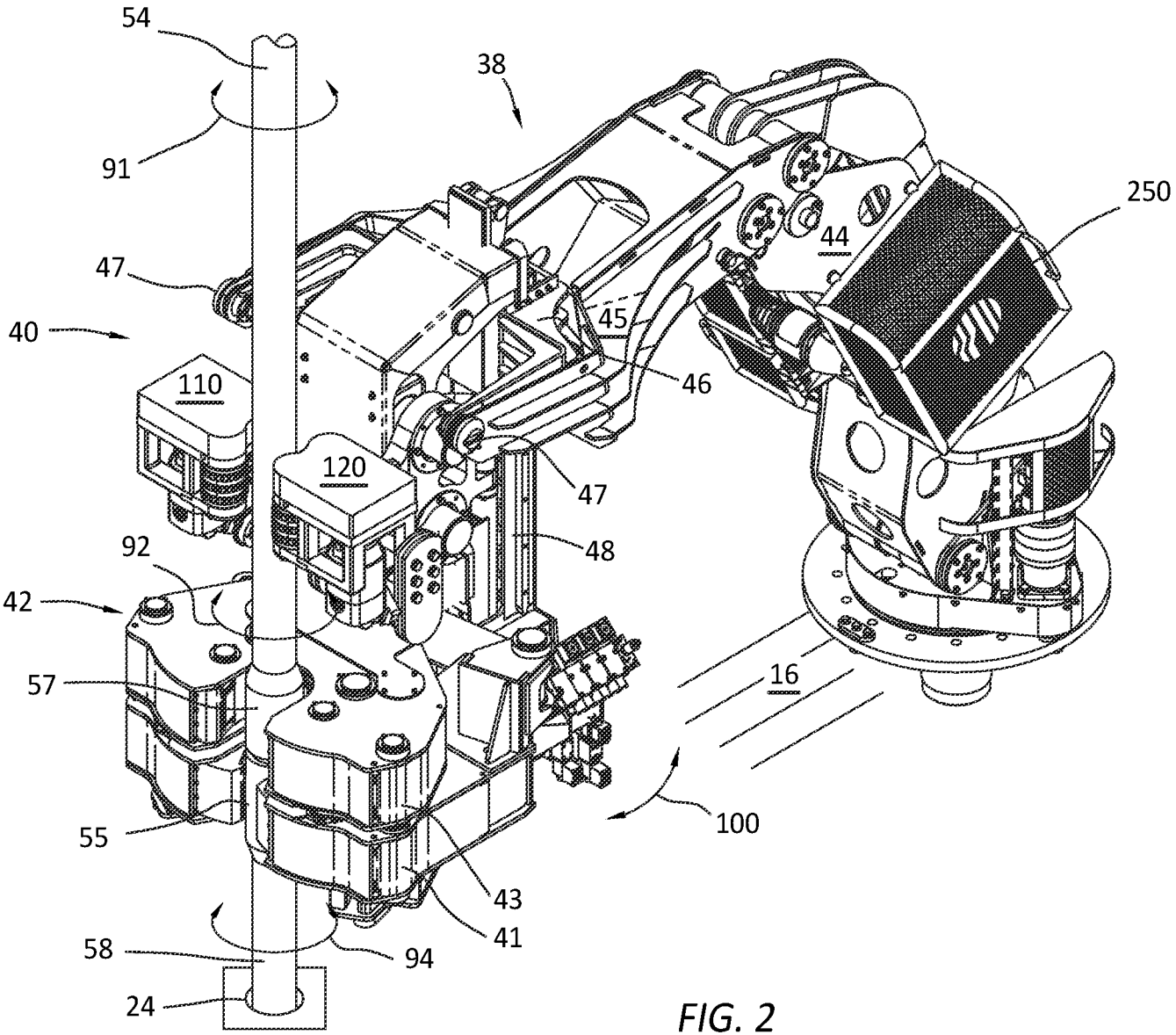
FIG. 2 is a representative perspective view of an iron roughneck on a rig floor, in accordance with certain embodiments.

FIG. 2 is a representative perspective view of an iron roughneck 38 with a spinner assembly 40 on a rig floor 16 with a body of the tubular 54 engaged with the spinner assembly 40 and the torque wrench assembly 42 gripping both the box end 55 of the tubular string 58 and the pin end 57 of the tubular 54. The iron roughneck 38 can include a robot arm 44 that supports the iron roughneck 38 from the rig floor 16. The robotic arm 44 can include a support arm 45 that can couple to a frame 48 via a frame arm 46. The support arm 45 can support and lift the frame 48 of the iron roughneck 38 via the frame arm 46, which can be rotationally coupled to the support arm 45 via the pivots 47. The frame 48 can provide structural support for the spinner assembly 40 and the torque wrench assembly 42. The robotic arm 44 can move the frame 48 from a retracted position (i.e., away from the well center 24) to an extended position (i.e., toward the well center 24) and back again as needed to provide support for making or breaking connections in the tubular string 58. In the extended position of the frame 48, the spinner assembly 40 and the torque wrench assembly 42 can engage the tubular 54 and the tubular string 58, as desired.

The top drive 18 (not shown) can rotate the tubular string 58 in either clockwise or counterclockwise directions as shown by arrows 94. The tubular string 58 is generally rotated in a direction that is opposite the direction used to unthread tubular string 58 connections. When a connection is to be made or broken, a first wrench assembly (or backup tong) 41 of the torque wrench assembly 42 can grip the box end 55 of the tubular string 58. The first wrench assembly 41 can prevent further rotation of the tubular string 58 by preventing rotation of the box end 55 of the tubular string 58.

If a connection is being made, the spinner assembly 40 can engage the tubular 54 at a body portion, which is the portion of the tubular between the pin end 57 and box end 55 of the tubular 54. With the pin end 57 of the tubular 54 engaged with the box end 55 of the tubular string 58, the spinner assembly 40 can rotate the tubular 54 in a direction (arrows 91) to thread the pin end 57 of the tubular 54 into the box end 55 of the tubular string 58, thereby forming a connection of the tubular 54 to the tubular string 58. When a pre-determined torque of the connection is reached by the spinner assembly 40 rotating the tubular 54 (arrows 91), then a second wrench assembly (or torque wrench) 43 of the torque wrench assembly 42 can grip the pin end 57 of the tubular 54 and rotate the pin end 57. By rotating the second wrench assembly 43 relative to the first wrench assembly 41 (arrows 92), the torque wrench assembly 42 can torque the connection to a desired torque, thereby completing the connection of the tubular 54 to the tubular string 58. The iron roughneck can then be retracted from the well center 24 and the subterranean operation can continue.

If a connection is being broken, the spinner assembly 40 can engage the tubular 54 at the body portion. The first wrench assembly 41 can grip the box end 55 of the tubular string 58 and the second wrench assembly 43 can grip the pin end 57 of the tubular 54. By rotating the pin end 57 of the tubular 54 relative to the box end 55 of the tubular string 58, the previously torqued connection can be broken loose. After the connection is broken, the spinner assembly 40 can rotate the tubular 54 relative to the tubular string 58 (arrows 91), thereby releasing the tubular 54 from the tubular string 58. The tubular 54 can then be removed from the well center by the top drive or pipe handler (or other means) and the iron roughneck retracted from the well center 24 to allow the top drive access to the top end of the tubular string 58.

The position of the spinner assembly 40 and wrench assembly 42 relative to the rig floor 16 (and thus the tubular string 58) can be controlled by the rig controller 250 via the robotic arm 44 and the frame arm 46, which is moveable relative to the frame 48. The rig controller 250 or other controllers, via the robotic arm 44, can manipulate the frame 48 by lifting, lowering, extending, retracting, rotating the arm, etc. The robotic arm 44 can be coupled to the frame 48 via the support arm 45 which can be rotatably coupled to the frame arm 46 via pivots 47. The frame 48 can move up and down relative to the frame arm 46 to raise and lower the spinner assembly 40 and wrench assembly 42 as needed to position the assemblies 40, 42 relative to the tubular string 58. The frame 48 can also tilt (arrows 100) via pivots 47 to longitudinally align a center axis of the assemblies 40, 42 relative to the tubular string 58.

Figure 3A:
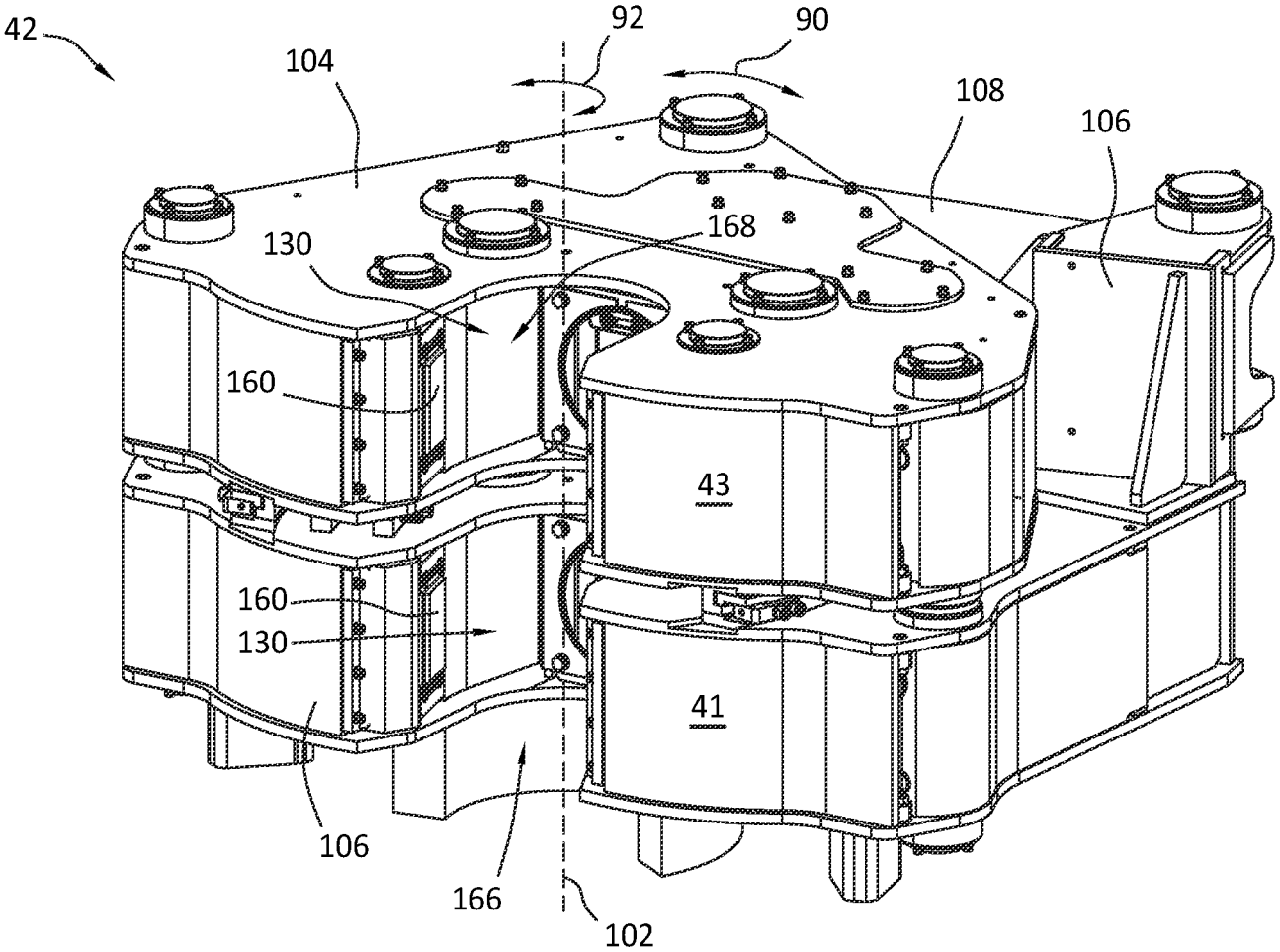
FIG. 3A is a representative perspective view of a wrench assembly of the iron roughneck of FIG. 2, in accordance with certain embodiments.

FIG. 3A is a representative perspective view of a wrench assembly 42 of the iron roughneck 38. The wrench assembly 42 can include a torque wrench 43 and a backup tong 41 for making or breaking joints in a tubular string 58. The torque wrench 43 can include a wrench 130 assembled within a body 104, where the body 104 provides structural support for the wrench 130 components of the torque wrench 43. The body 104 can be rotationally attached to a chassis 106, and coupled to each other through a torque actuator 108, where extending or contracting the torque actuator 108 (arrows 90) can rotate (arrows 92) the body 104 (and thus the torque wrench 43) relative to the chassis 106 about the axis 102. The chassis 106 provides structural support for the wrench 130 components of the backup tong 41. An opening 168 in the torque wrench 43 aligns with an opening 166 in the backup tong 41, such that the center of each opening 166, 168 is in line with the center axis 102 of the wrench assembly 42, with the torque wrench 43 being positioned above the backup tong 41. The wrench 130 of the torque wrench 43 is similar if not the same as the wrench 130 of the backup tong 41. Both wrenches 130 can extend a plurality of grippers 160 into engagement of a tubular joint that has been received in the openings 166, 168.

Figure 3B:
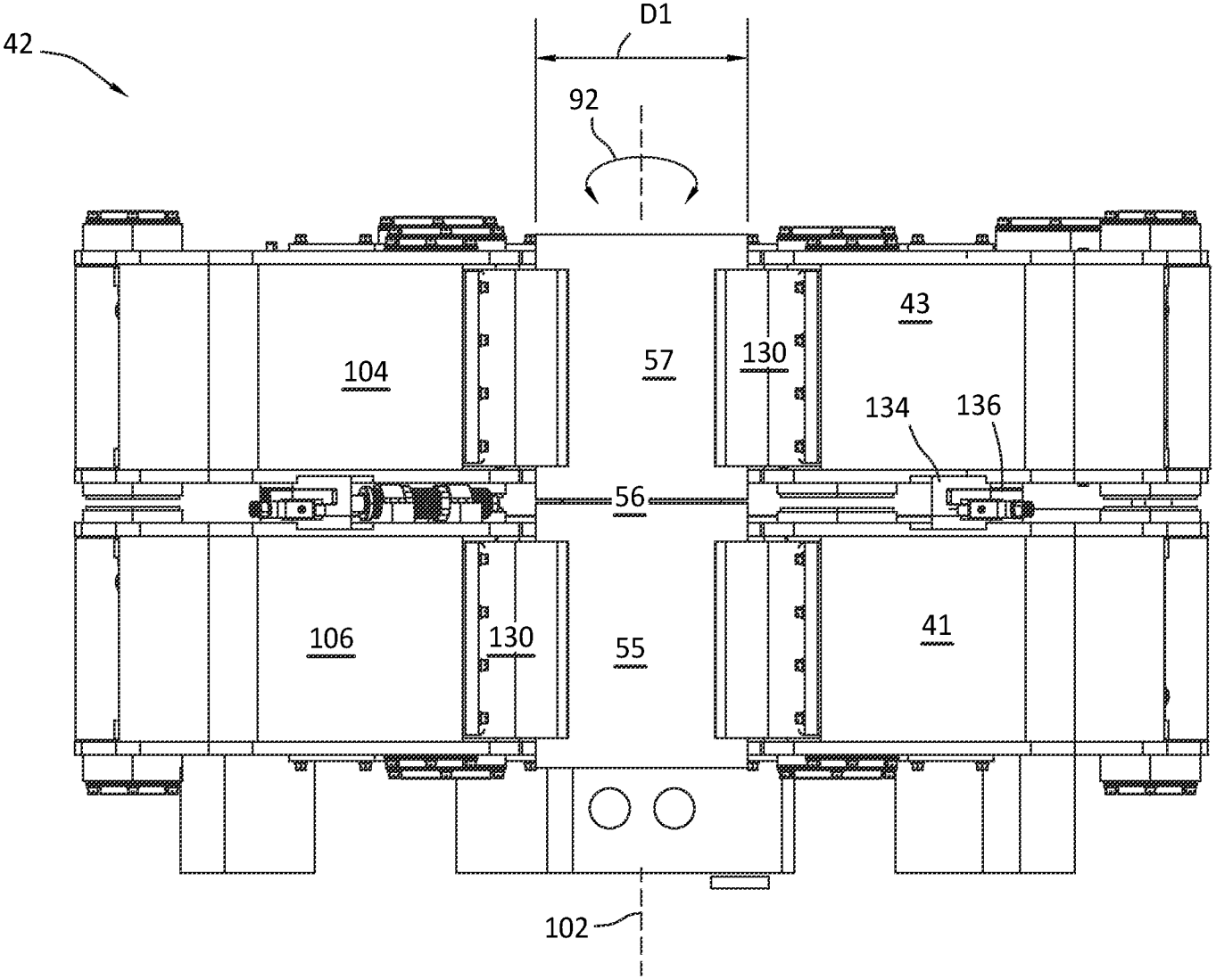
FIG. 3B is a representative front view of a wrench assembly of the iron roughneck of FIG. 2 with a tubular joint engaged with the wrench assembly, in accordance with certain embodiments.

FIG. 3B is a representative front view of a wrench assembly 42 of the iron roughneck 38 with a tubular joint 56 (including pin end 57 threaded into box end 55) engaged with the wrench assembly 42. A tubular joint 56 has been received in the openings 168, 166 of the torque wrench 43 and the backup tong 41, respectively. The plurality of grippers 160 of the torque wrench 43 have been engaged with the pin end 57 of the tubular joint 56, and the plurality of grippers 160 of the backup tong 41 have been engaged with the box end 55 of the tubular joint 56. The body 104 of the torque wrench 43 (including a wrench 130) has been slightly rotated (arrows 92) about the axis 102 relative to the chassis 106 and the backup tong 41 (which also includes a wrench 130).

The torque wrench 43 can include a circular guide 134 mounted to a bottom of the body 104 of the torque wrench 43. The circular guide 134 interlocks with a circular channel 136 and is slidingly coupled to the circular channel 136. The circular channel 136 is mounted to the top of the backup tong 41 portion of the chassis 106. As the body 104 is rotated relative to the chassis 106, the circular guide 134 slides along the circular channel 136 causing the body 104 to rotate substantially about the axis 102.

The wrench assembly 42 can support tubulars with an outer diameter D1. The outer diameter D1 can range from 11 inches down to 2 inches. The wrench assembly of the current disclosure can deliver up to 120K ft-lb (162.7 Kn-m) torquing force to a tubular joint 56 to make or break the joint connection. Gripping force for each gripper can be up to 60K pounds.

Figure 3C:
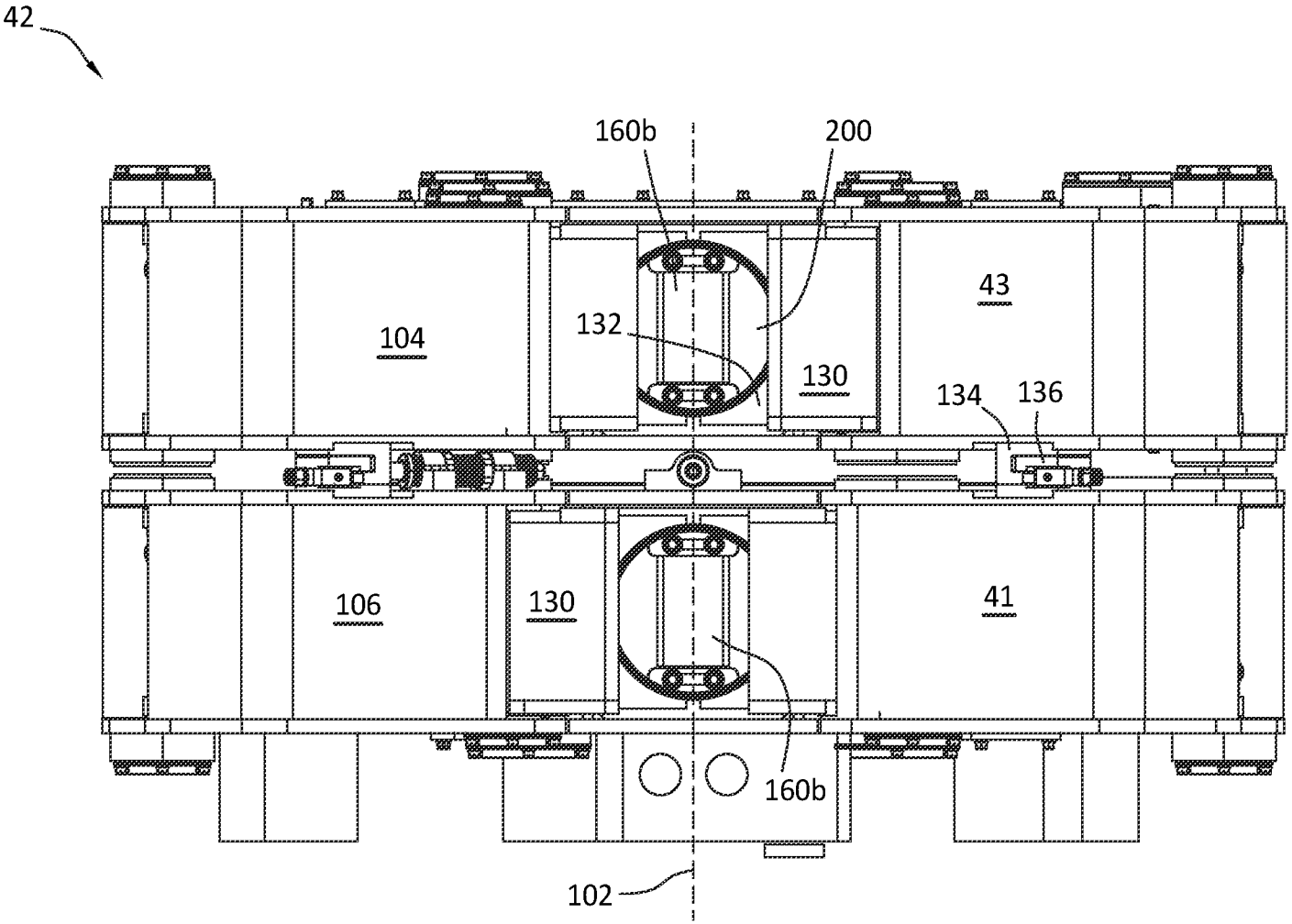
FIG. 3C is a representative front view of a wrench assembly of the iron roughneck of FIG. 2 without a tubular joint engaged with the wrench assembly, in accordance with certain embodiments.

FIG. 3C is a representative front view of a wrench assembly 42 of the iron roughneck 38 with the tubular joint 56 removed for clarity. The body 104 is still slightly rotated relative to the chassis 106 via the torque actuator 108 (not shown, see FIG. 3A), the circular guide 134, and the circular channel 136. A rear (or center) gripper 160*b* can be seen at the back of each of the openings 166, 168. The gripper 160*b* can be mounted to an end of a center actuator 200 coupled to a support 132, where the center actuator 200 extends and retracts into and out of engagement with a tubular joint 56, respectively.

The following discussion for FIGS. 4-9 generally refer to the wrench 130 in the torque wrench 43 but can also be applied for understanding the wrench 130 in the backup tong 41, that is if the backup tong 41 utilizes the wrench 130.

Figure 4:
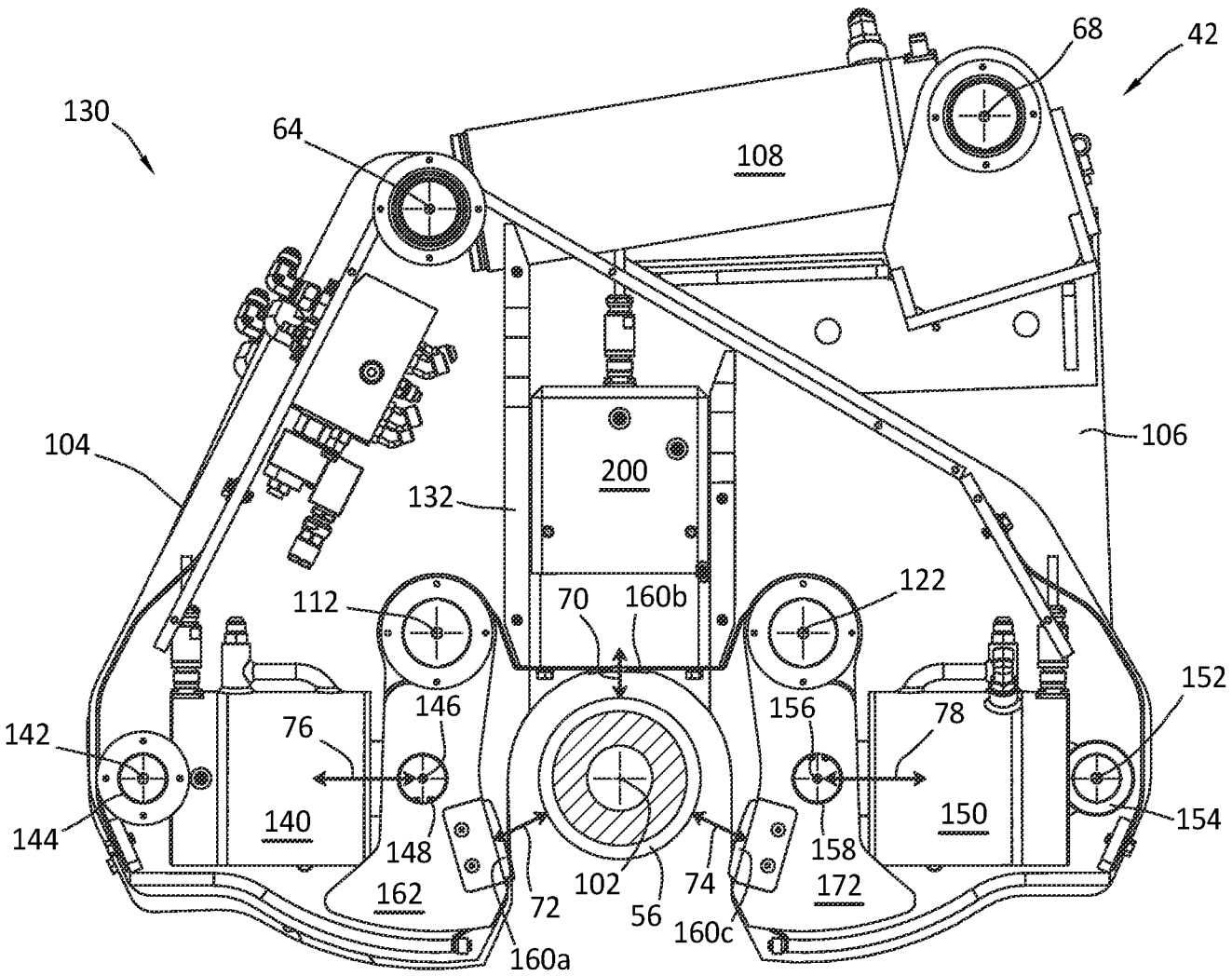
FIG. 4 is a representative partial cross-sectional top view of a wrench of the wrench assembly in an unengaged configuration, in accordance with certain embodiments.

FIG. 4 is a representative partial cross-sectional top view of a wrench 130 of the wrench assembly 42 in an unengaged configuration, in accordance with certain embodiments. In a certain embodiment, a tubular joint 56 can be received into the openings 166, 168 of the wrench assembly 42. A backup tong 41 can engage the box end 55 of the tubular joint 56 with multiple grippers 160*a-c* to prevent rotation of the box end 55. A torque wrench 43 can engage the pin end 57 of the tubular joint 56 with multiple grippers 160*a-c* to rotate the pin end 57 relative to the box end 55 to make up or break up the tubular joint 56. To engage the pin end 57, the torque wrench 43 can extend the left actuator 140, the right actuator 150 and the center actuator 200 to extend the grippers 160*a-c* into engagement with an external surface of the pin end 57. Each of the actuators 140, 150, 200 can be hydraulically or electrically actuated.

The left actuator 140 can be coupled between a left arm 162 and the body 104. One end 144 of the left actuator 140 can be coupled to the body 104 at a pivot axis 142, with the other end 148 coupled to the left arm 162 at a pivot axis 146. As the left actuator 140 extends (arrows 76), the left arm 162 is rotated about the pivot axis 112, extending the gripper 160*a* toward the tubular joint 56 (arrows 72).

The right actuator 150 can be coupled between a right arm 172 and the body 104. One end 154 of the right actuator 150 can be coupled to the body 104 at a pivot axis 152, with the other end 158 coupled to the right arm 172 at a pivot axis 156. As the right actuator 150 extends (arrows 78), the right arm 172 is rotated about the pivot axis 122, extending the gripper 160*c* toward the tubular joint 56 (arrows 74).

In a certain embodiment, the center actuator 200 may not be coupled to a lever arm, but extends or retracts the gripper 160*b* directly (arrows 70). With the actuators 140, 150, 200 extended, the grippers 160*a-c* can be engaged with the tubular joint 56 to control rotation of the pin end 57.

Figure 5:
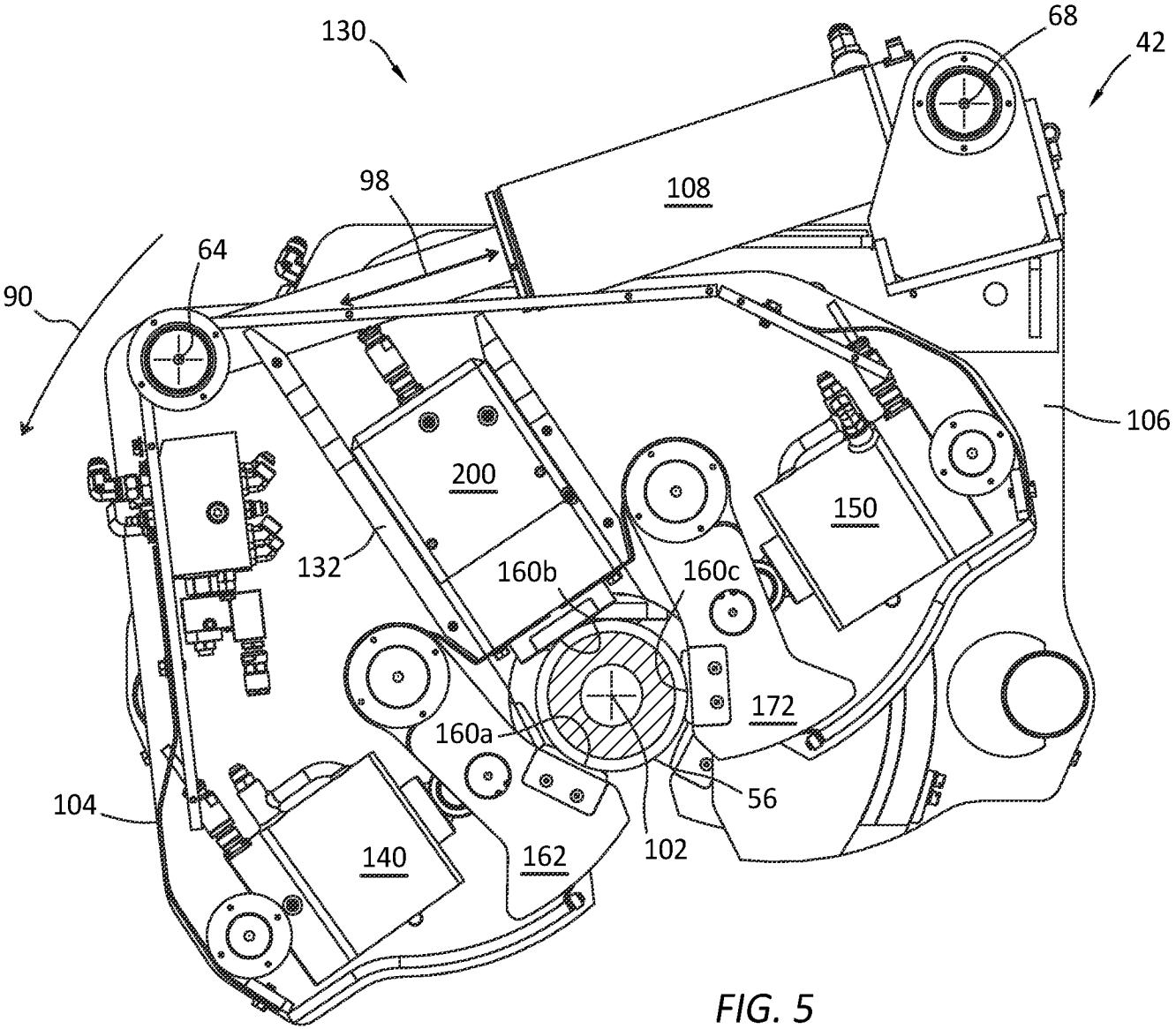
FIG. 5 is a representative partial cross-sectional top view of a wrench of the wrench assembly in an engaged configuration with a tubular joint, in accordance with certain embodiments.

FIG. 5 is a representative partial cross-sectional top view of a wrench 130 of the wrench assembly 42 in an engaged configuration with a tubular joint 56, in accordance with certain embodiments. With the grippers 160*a-c* engaged with the tubular joint 56, the torque wrench 43 can be rotated (arrows 90) relative to the backup tong 41 by extending the actuator 108 (arrows 98), which is coupled to the chassis 106 via the pivot axis 68 at one end and coupled to the body 104 at pivot axis 64 at an opposite end. During rotation of the pin end 57 to makeup or breakup the tubular joint 56, either one of the grippers 160*a*, 160*c* may slip relative to the pin end 57. In a novel configuration, when either one of the grippers 160*a*, 160*c* slip, the gripping force for both grippers 160*a*, 160*c* will increase to further disable slipping of either one of the grippers 160*a*, 160*c* with the pin end 57. In the same manner, if the grippers 160*a*, 160*c* of the backup tong 41 were to slip on the box end 55, then the novel configuration would cause the gripping force for both grippers 160*a*, 160*c* to increase and further disable slipping of either one of the grippers 160*a*, 160*c* of the backup tong 41 with the box end 55. In this manner, the actuators 140, 150 can self-intensify to increase the gripping force of the grippers 160*a*, 160*c* to the tubular joint 56 without supply pressure to the hydraulic control circuitry being increased.

Figure 6:
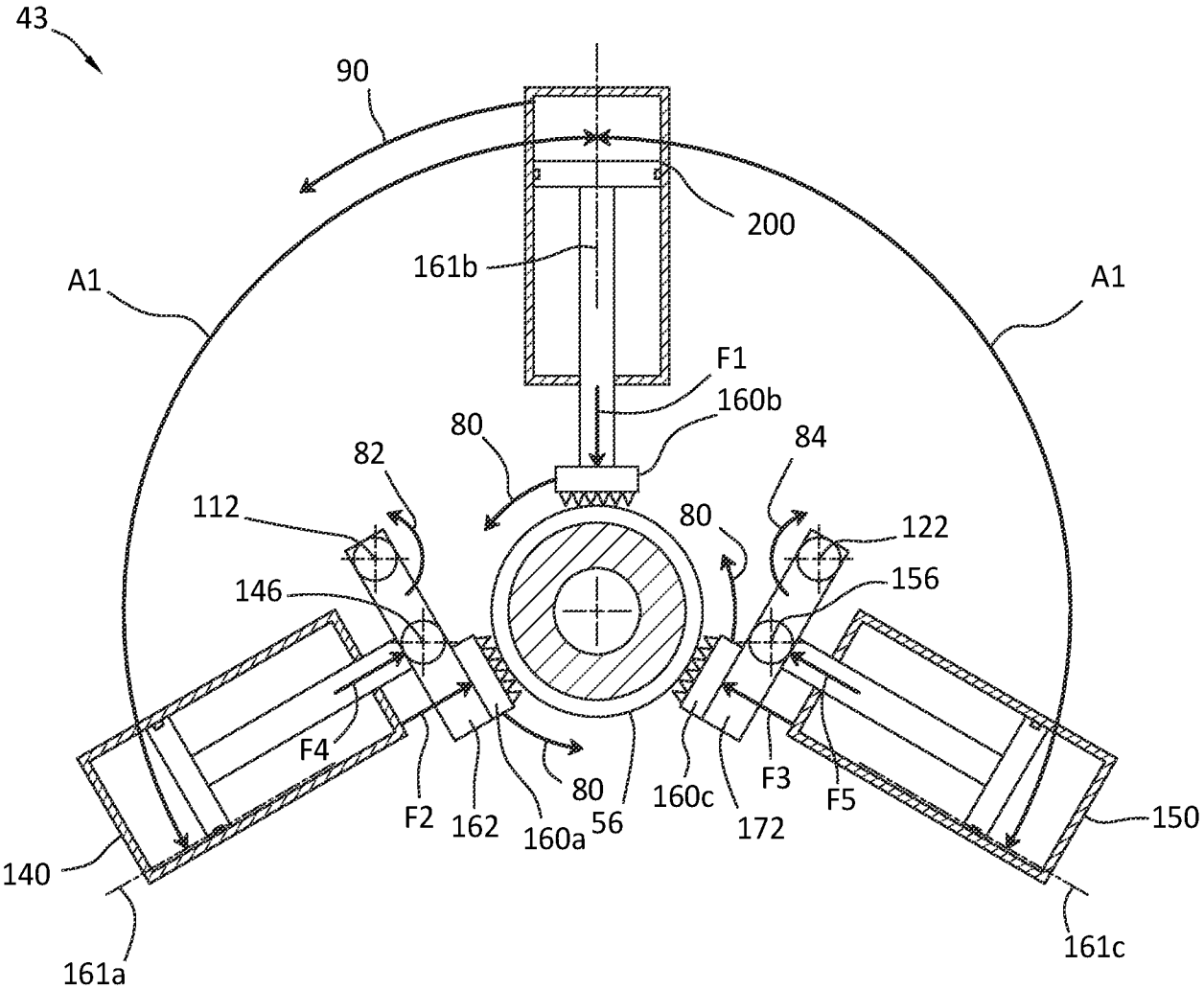
FIG. 6 is a simplified top view of a wrench of a wrench assembly engaged with a tubular joint, in accordance with certain embodiments.

FIG. 6 is a simplified top view of a wrench 130 of a wrench assembly 42 engaged with a tubular joint 56, in accordance with certain embodiments. The grippers 160*a-c* can be equally distributed around the center axis 102 when engaged with the tubular joint 56, such as the angle A1 being 120 degrees, with the angle A1 being measured from generally the center axis 161*a-c* of one of the grippers 160*a-c* to generally the center of an adjacent center axis 161*a-c* of one of the grippers 160*a-c*. It may be preferred that the angle A1 generally equal 120 degrees, but it should be understood that the angle A1 can be other angles in keeping with the principles of this disclosure. For example, the angle A1 can be between 110 degrees and 140 degrees. It is also preferred that the arc (which can be represented by the angle A1 on the left side of FIG. 6) between the center axis 161*a* of gripper 160*a* and the center axis 161*b* of gripper 160*b* be substantially equal to the arc (which can be represented by the angle A1 on the right side of FIG. 6) between the center axis 161*b* of gripper 160*b* and the center axis 161*c* of gripper 160*c*.

In a certain embodiment, when the actuators 140, 150, 200 are extended and cause the grippers 160*a-c* to engage with the tubular joint 56. The forces F2, F3 applied by the grippers 160*a*, 160*c* can engage the tubular joint 56 with a substantially equal force, and the forces F2, F3 are preferably less than the force F1 applied by the gripper 160*b*. In a certain embodiment, as in FIG. 6, the actuators 140, 150 are coupled to a pivot arm 162, 172, respectively, via pivot axes 146, 156, respectively.

As the actuator 140 is extended, the pivot arm 162 is pivoted (arrows 82) about the axis 112 and toward the tubular joint 56. Due to the pivot arm 162 configuration, the force F2 applied to the tubular joint 56 will be reduced when compared to the force F1, when the hydraulic pressure driving both actuators 140, 200 is substantially equal to each other. This is also true for the actuator 150.

As the actuator 150 is extended, the pivot arm 172 is pivoted (arrows 84) about the axis 122 and toward the tubular joint 56. Due to the pivot arm 172 configuration, the force F5 applied to the tubular joint 56 will be reduced when compared to the force F1, when the hydraulic pressure driving both actuators 150, 200 is substantially equal to each other. Therefore, if the forces F1, F4, F5 are substantially equal, the forces F2, F3 will be less than the force F1, due to the application of the forces F2, F3 via the pivot arms 162, 172.

The hydraulic pressure driving actuators 140, 150 is preferably equalized such that the forces F2, F3 are substantially equal to each other, with the forces F2, F3 both being less than the force F1. When the grippers 160*a-c* are engaged with the tubular joint 56, the grippers tend to bite into the surface of the tubular joint 56. Therefore, when the torque wrench 43 is rotated (arrows 90) relative to the backup tong 41 (e.g., for torquing or untorquing the tubular joint 56), the grippers 160*a-c* engage the tubular joint 56 and rotate (arrows 80) along with the torque wrench 43. The engagement of the grippers 160*a-c* with the tubular joint 56 (e.g., a pin end 57 engaged with the torque wrench 43) tends to impart a similar rotation to the tubular joint 56 (e.g., the pin end 57), when the grippers 160*a-c* do not slip relative to the tubular joint 56. When slippage occurs, then hydraulic supply pressure to the actuators 140, 150, 200 may be increased to increase the respective forces F2, F3, F1 to further discourage slippage between the tubular joint 56 and the grippers 160*a-c*. Without the self-intensifier of the current disclosure, when slippage occurs it can require stopping rotation (arrows 90) of the torque wrench 43, increasing hydraulic supply pressure to the actuators 140, 150, 200, and again rotating the pin end 57 of the tubular joint 56 via the torque wrench 43. This can be repeated as needed to ensure, for example, the pin end 57 coupled to the torque wrench 43 or the box end 55 coupled to the backup tong 41 does not slip substantially relative to the grippers 160*a-c* in the respective wrench 130.

The inventor(s) have discovered how to provide a self-intensifying configuration for the actuators 140, 150 that responsively (or automatically) intensifies (or increases) the forces F2, F3 when at least one of the grippers 160*a*, 160*c* slip relative to the tubular joint 56. As used herein, "slip", "slipping", slippage", refers to when a gripper is engaged with a pin end 57 or box end 55 of the tubular joint 56, and the gripper rotates relative to the pin end 57 or box end 55 while the gripper is engaged with the pin end 57 or box end 55. This is not referring to when a gripper is engaged with a pin end 57 and rotates relative to a box end 55 (or vice versa when the gripper is engaged with a box end 55 and rotates relative to a pin end 57), which occurs as desired when the tubular joint 56 is being torqued to makeup or breakup the tubular joint 56.

When either one of the grippers 160*a*, 160*c* slip relative to the portion of the tubular joint 56 to which they are engaged, then the self-intensifier increases the forces F2, F3 to increase engagement of the grippers 160*a*, 160*c* to the portion of the tubular joint 56 (i.e., pin end 57 or box end 55) to counteract the slippage and substantially prevent further slippage.

In certain embodiments, when the grippers 160*a-c* are urged toward engagement with the tubular joint 56, although the force F1 being applied by the gripper 160*b* of the actuator 200 is greater than the forces F2, F3 being applied by the respective grippers 160*a*, 160*c* of the respective actuators 140, 150, the force F1 cannot overcome a friction force imparted to the tubular joint 56 by the forces F2, F3 being applied by the respective grippers 160*a*, 160*c*. When the grippers 160*a-c* are moved toward engagement with the tubular joint 56, the grippers 160*a* and 160*c* can effectively lock the tubular joint 56 in place between the grippers 160*a*, 160*c* when the grippers 160*a*, 160*c* engage the tubular joint 56, (or more specifically an outer surface of the tubular joint 56) the grippers 160*a*, 160*c* can penetrate the outer surface of the tubular joint 56. Once the grippers 160*a*, 160*c* penetrate the outer surface, they can create a friction lock between the grippers 160*a*, 160*c*, even though the force F1 applied by the gripper 160*b* is greater than the forces F2, F3.

When high torque is applied to the tubular joint 56, then material deformation of the outer surface of the tubular joint 56 can result in elongation of the penetrations of the grippers 160*a*, 160*c* that penetrate the outer surface of the tubular joint 56. When the elongation of the gripper 160*a*, 160*c* penetrations occur (i.e., slippage), the locking force that opposes the force F1 applied by the gripper 160*b* (which created the friction lock) can be released as a result of friction slip (or slippage). The force F1, which exceeds the forces F2, F3 will impart its greater force F1 to the tubular joint 56. The hydraulically locked actuators 140, 150 (i.e., where fluid is prevented from flowing away from the actuators 140, 150) will, as a result of the increased force F1, increase pressure in the actuators 140, 150 until the forces F2, F3 become equal and opposite to the increased force F1.

This current disclosure provides embodiments that can result in greater gripping force being applied to the tubular joint 56 should slippage of the grippers 160*a*, 160*c* occur. Traditional roughnecks may not be capable of rapidly increasing their gripping forces to counteract slippage of the grippers. Thus, when die slippage occurs in traditional roughnecks, damage to the grippers, as well as energies being released and imparted to the tool can occur. The energies released may result in catastrophic damage to the traditional roughnecks. The current disclosure can prevent (or at least significantly reduce) such damage being caused by these released energies.

Figure 7:
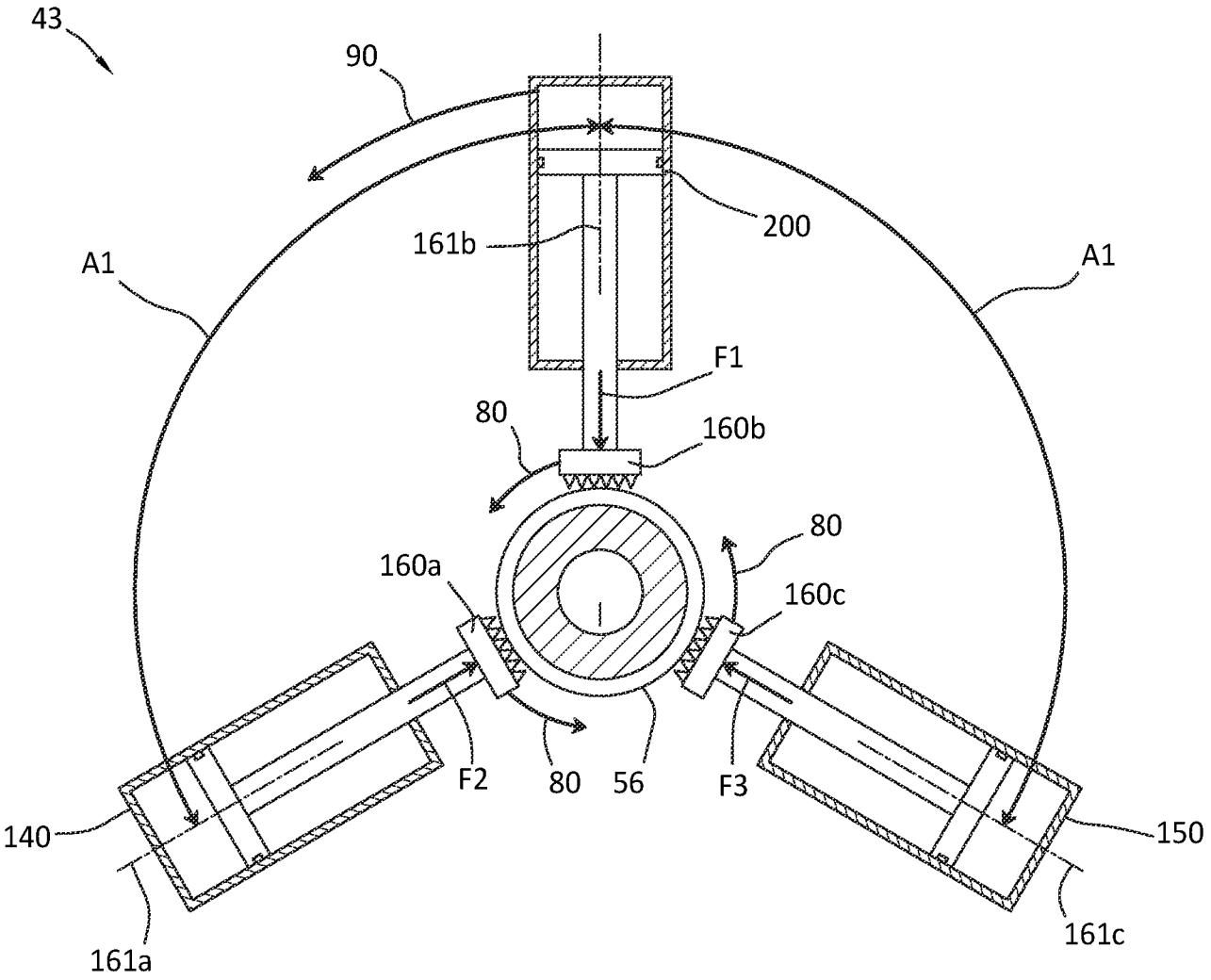
FIG. 7 is another simplified view of a wrench of a wrench assembly engaged with a tubular joint, in accordance with certain embodiments.

This self-intensification can also operate with an actuator configuration as given in FIG. 7, which is a simplified view of a wrench 130 of a wrench assembly 42 engaged with a tubular joint 56, in accordance with certain embodiments. In this configuration, the actuators 140 and 150 can directly apply engagement forces F2, F3, respectively, without transmitting an engagement force indirectly through a pivot arm. The self-intensification feature of the wrench 130 functions as desired when the hydraulic pressure applied to the actuators 140, 150 is less than the hydraulic pressure supplied to the actuator 200. This preferably causes the forces F2, F3 to be less than the force F1 from the actuator 200, when the actuators 140, 150, 200 are of the same type. However, it should be understood that actuators 140, 150 that supply less engagement force than the actuator 200 when all actuators are supplied with substantially the same hydraulic pressure, is in keeping with the principles of this disclosure.

Similar to the description above regarding FIG. 6, the actuators 140, 150 can responsively intensify (or increase) the forces F2, F3 when at least one of the grippers 160*a*, 160*c* slip relative to a portion of the tubular joint to which they are engaged. When either one of the grippers 160*a*, 160*c* slip relative to the portion of the tubular joint 56, then the self-intensifier increases the forces F2, F3 thereby increasing engagement of the grippers 160*a*, 160*c* to the portion of the tubular joint 56 (i.e., pin end 57 or box end 55) to counteract the slippage.

Figure 8:
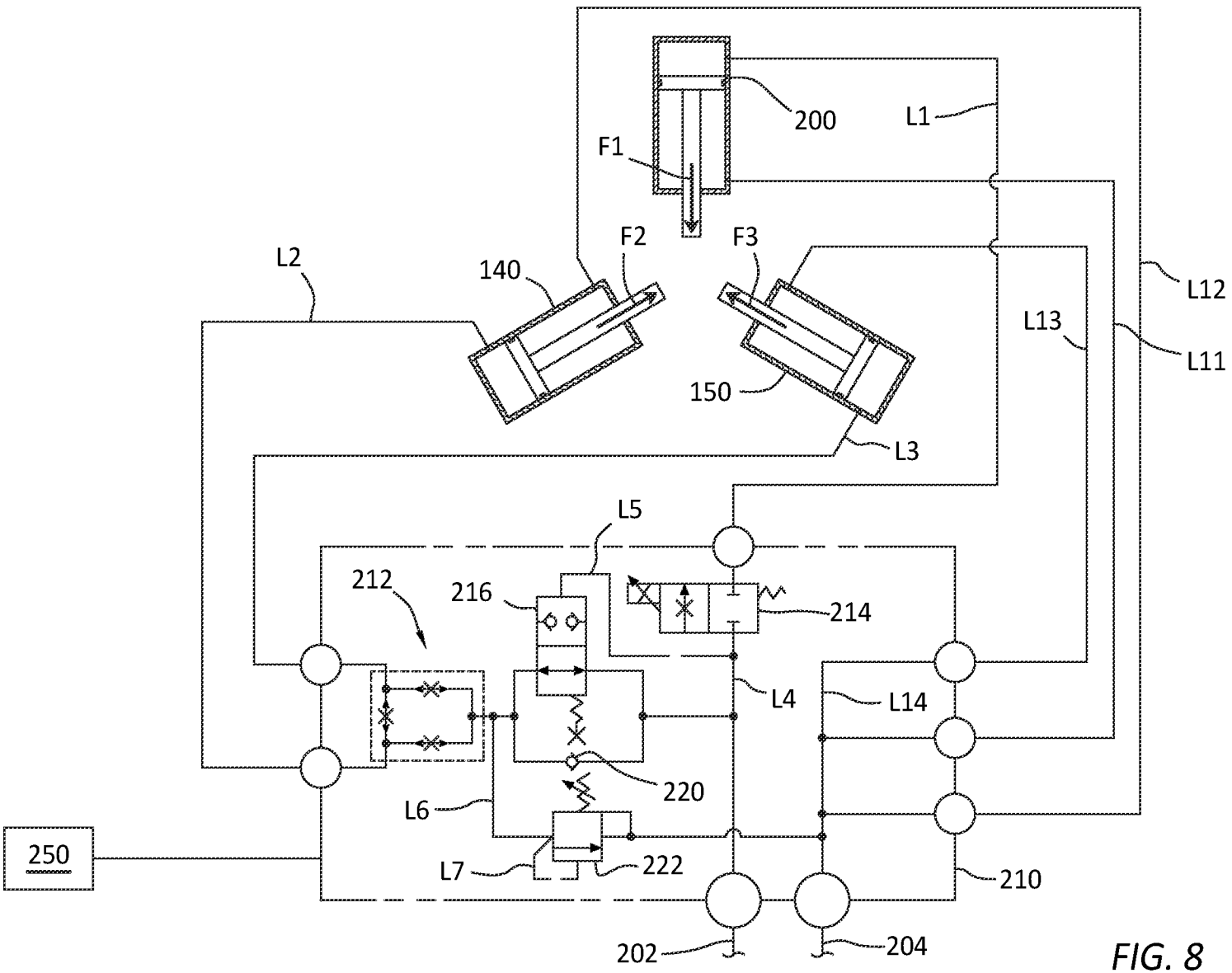
FIG. 8 is a representative hydraulic control diagram of a wrench of a wrench assembly, in accordance with certain embodiments.

FIG. 8 is a representative hydraulic circuit diagram of a wrench 130 of a wrench assembly 42, in accordance with certain embodiments. The rig controller 250 (as well as other remote or local controllers) can be used to control the wrench 130 via the hydraulic circuitry shown in FIG. 8. In a certain embodiment, a manifold 210 can receive control signals from the rig controller 250. The manifold 210 can receive hydraulic fluid from either one of the hydraulic control lines 202, 204, where hydraulic pressure received via the control line 202 acts to extend one or more of the actuators 140, 150, 200, and hydraulic pressure received via the control line 204 acts to retract one or more of the actuators 140, 150, 200. The manifold 210 receives the hydraulic pressure inputs 202, 204 and distributes the pressurized hydraulic fluid to the actuators 140, 150, 200. When the input 202 receives pressurized hydraulic fluid, then the input 204 can act as a drain line to allow the pistons of the actuators 140, 150, 200 to drain fluid from the side of the piston that is opposing extension of the piston, thereby allowing extension of the pistons. If pressure is applied via the input 204, then the input 202 can act as a drain line to allow the pistons of the actuators 140, 150, 200 to drain fluid from the side of the piston that is opposing retraction of the piston, thereby allowing retraction of the pistons.

Therefore, if hydraulic pressure is applied to the actuator 200 via line L1 from the manifold 210, then the piston of the actuator 200 can extend, while pushing hydraulic fluid out of the piston via line L11. If hydraulic pressure is applied to the actuator 140 via line L2 from the manifold 210, then the piston of the actuator 140 can extend, while pushing hydraulic fluid out of the piston via line L12. If hydraulic pressure is applied to the actuator 150 via line L3 from the manifold 210, then the piston of the actuator 150 can extend, while pushing hydraulic fluid out of the piston via line L13. Inversely, if the hydraulic pressure is applied to the actuators 200, 140, 150, via lines L11, L12, L13, then the actuators 200, 140, 150 can retract, while pushing hydraulic fluid out of the pistons via lines L1, L2, L3, respectively.

In this configuration, if hydraulic pressure is applied to the input 202 and all the actuators of the same type actuators (or more particularly, the same type piston), then the pistons can produce the same amount of engagement force, such that forces F1, F2, F3 are substantially equal. As described in FIG. 6, with the actuators 140, 150 coupled to respective pivot arms, the amount of engagement force delivered to the tubular joint 56 is reduced when compared to the engagement force F1 applied by actuator 200, which supplies the force F1 directly to the tubular joint 56.

As used herein in reference to FIG. 8, terms such as up, upper, top, down, lower, bottom, left, right, or side are relative terms as viewed in FIG. 8. Therefore, top refers to a feature that is towards the top of the figure, bottom refers to a feature that is towards the bottom of the figure, left refers to a feature that is towards the left of the figure, and right refers to a feature that is towards the right of the figure. These relative terms are merely used to assist in understanding the description as related to the items in the figure. They are not intended to limit the scope of the claims.

In operation, receiving pressurized hydraulic fluid at the input 202 will pressurize the line L4 which feeds the shuttle valve 214. With 214 actuated to the right, the input pressure in line L4 will be delivered to the piston of actuator 200 via the line L1. When the desired pressure is reached, the shuttle valve 214 can be actuated to the left to trap the hydraulic pressure in line L1, thereby causing the actuator 200 to produce an engagement force F1. The line L11 allows the hydraulic fluid in the piston that would oppose extension of the actuator 200 to drain out (or bleed out) of the piston.

Receiving the pressurized hydraulic fluid at the input 202 will pressurize the line L4 which feeds the shuttle valve 216. Pressure in line L4 can be sensed by line L5, and if the pressure in line L4 is greater than a predetermined level (e.g., 150 psi), the pressure in line L5 can actuate the shuttle valve 216 from a position that allows fluid flow to move in both directions through the shuttle valve 216, to a position that prevents fluid flow to move in either direction through the shuttle valve 216. With pressure in line L4 above the predetermined level, line L5 can actuate the shuttle valve 216, to prevent flow through the shuttle valve 216. A fluid path connected in parallel with the shuttle valve 216 can contain a check valve 220, which allows fluid to flow toward the actuators 140, 150, but prevents flow through the check valve away from the actuators 140, 150. Therefore, as hydraulic pressure is applied to line L4, then that hydraulic pressure is supplied through the check valve 220 to a pressure equalizer, which forces the hydraulic pressure in line L2 to the actuator 140 to be substantially equal to the hydraulic pressure in line L3 to the actuator 150. By equalizing the pressure in the lines L2, L3, then the actuators 140, 150 can produce forces F2, F3, respectively, which are substantially equal to each other.

With the grippers of the actuators 200, 140, 150 of the wrenches 130 engaged with the tubular joint 56, then the wrench assembly 42 can begin to rotate the pin end 57 relative to the box end 55. If no slippage occurs, then the forces F1, F2, F3 will remain substantially unchanged and when rotation is complete, the actuators can be retracted to disengage the grippers 160*a-c*. However, if slippage occurs between either one of the grippers 160*a*, 160*c* of the actuators 140, 150, respectively, then the higher force F1 will force the tubular joint 56 further toward the actuators 140, 150 causing the actuators to react to the increased force applied against them by increasing the hydraulic pressure in the line L2, L3 because of the increased force being applied to the actuators 140, 150.

Since the check valve and the actuated shuttle valve 216 prevents fluid from flowing back to the line L4, then the pressure in the lines L2, L3 will intensify to stabilize the forces F1, F2, F3 applied to the tubular joint 56. In addition, the pressure equalizer 212 ensures that any increased pressure in the lines L2, L3 will be substantially equally distributed between them. Therefore, when either one of the grippers 160*a*, 160*c* of the respective actuators 140, 150 slips on the tubular joint, the hydraulic pressure driving the actuators 140, 150 self-intensifies to increase the engagement force of the grippers 160*a*, 160*c*.

If slippage of either one of the grippers 160*a*, 160*c* of the respective actuators 140, 150 occurs again, then the pressure in lines L2, L3 will again self-intensify and cause the engagement forces F2, F3 to increase further, by increasing pressure in the lines L2, L3. Since pressure in line L4 remains above the predetermined level, then line L5 will keep the shuttle valve 216 in the flow prevention position.

If for some reason the pressure in lines L2, L3 increases to an unsafe level, then the high pressure relief shuttle valve can be used to relieve the unsafe pressure to maintain the pressures in lines L2, L3 at safe levels. If pressure in line L6 increases to an unsafe level, then the line L7 can sense the unsafe pressure and actuate the shuttle valve 222 for a position that blocks fluid flow through the valve 222, to a position that allows fluid flow through the valve 222. When the pressure in line L6 drops below the unsafe level, the line L7 will sense this pressure drop and allow the shuttle valve to be actuated back to the flow prevention position.

When the tubular joint 56 has been made up or broke up, then the actuators 140, 150, 200 can be retracted by releasing pressure in the line L4 and increasing pressure in the line L14. Releasing pressure in line L4 below the predetermined level, then the line L5 can allow the shuttle valve 216 to return to the position that allows fluid flow in either direction. This will allow the fluid pressure in the lines L2, L3 to dissipate and allow the actuators 140, 150 to be retracted. The shuttle valve 214 can be actuated to allow fluid flow from the line L1 to line L4, thereby allowing the actuator 200 to be retracted.

The shuttle valves 214, 216 can be referred to as a flow controller, which controls, via the rig controller 250, the actuation pressures to the actuators 140, 150, 200 to extend the actuators such that the grippers 160*a-c* engage the tubular joint 56. As described above, the shuttle valve 216 controls supplying hydraulic pressure to the actuators 140, 150, via the pressure equalizer 212. The equalizer 212 receives hydraulic pressure from the shuttle valve 216 and supplies equalized pressure to the lines L2, L3, such that the pressure in line L2 is substantially equal to the pressure in line L3, even as the pressures are increased to extend the actuators 140, 150. The shuttle valve 214 controls pressure supplied to the actuator 200 via line L1, such that in one position, the shuttle valve 214 allows fluid flow to the line L1, thereby increasing pressure in the line L1, and in the other position fluid flow to or from the line L1 is prevented. Therefore, the actuation pressures for the actuators 140, 150 can be at a different pressure than the actuation pressure for the actuator 200.

Figure 9:
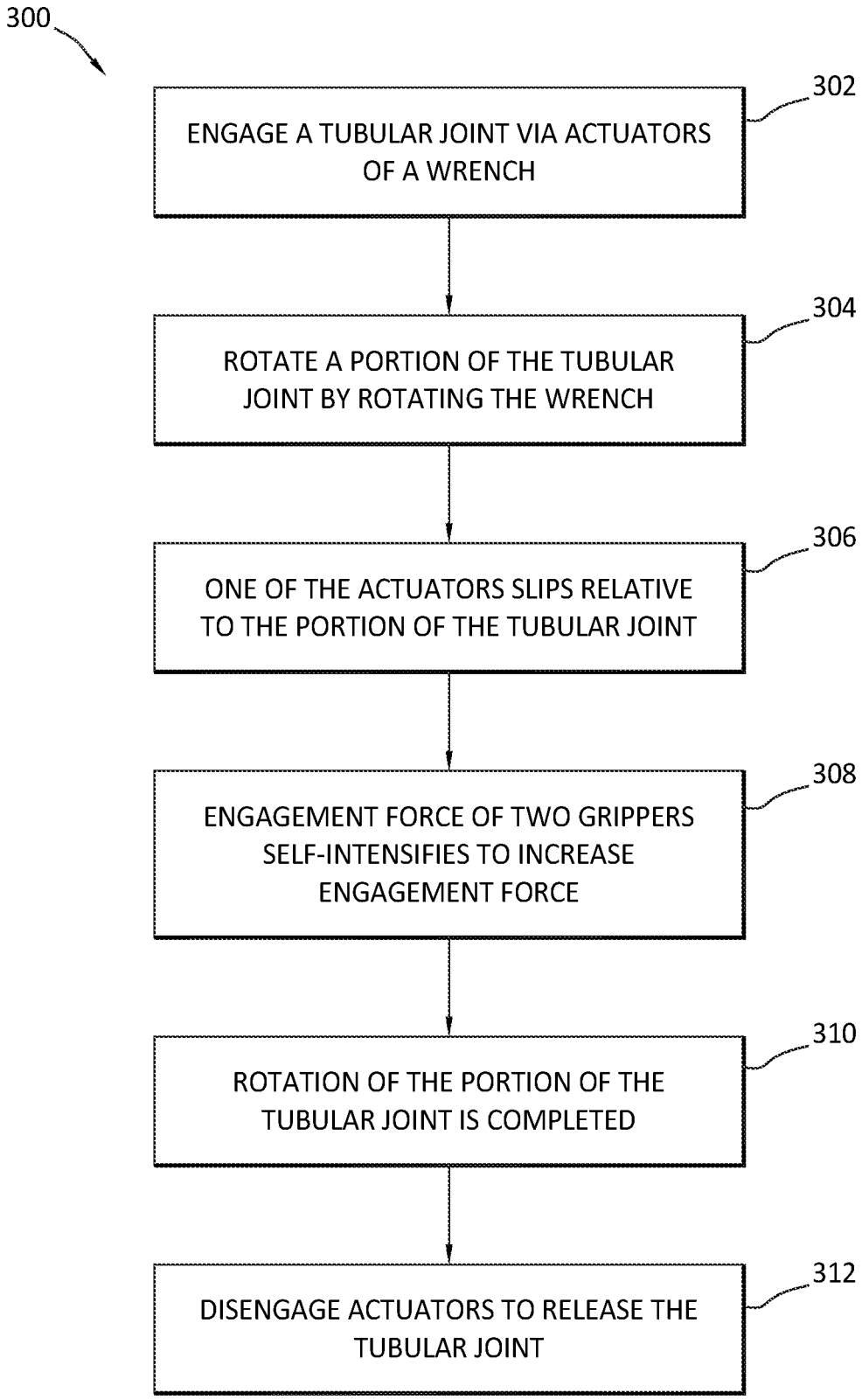
FIG. 9 is a representative flow diagram of a method for utilizing a self-intensifier to maintain a gripping engagement with a tubular joint, in accordance with certain embodiments.

FIG. 9 is a representative flow diagram of a method 300 for utilizing a self-intensifier to maintain a gripping engagement with a tubular joint to minimize slippage between the grippers 160*a-c* and a tubular joint 56, in accordance with certain embodiments. In operation 302, actuators 140, 150, 200 are extended to engage a tubular joint 56 via grippers 160*a-c*. The engagement force F1 applied to the tubular joint by the actuator 200 is greater than either one of the engagement forces F2, F3 applied by the respective actuators 140, 150.

In operation 304, with the wrench 130 engaged with a portion of the tubular joint 56 (e.g., the pin end 57 or the box end 55), then the wrench 130 can be rotated to cause rotation of the portion of the tubular joint 56. In operation 306, if one of the grippers 160*a*, 160*c* slips relative to the portion of the tubular joint 56, then, in operation 308, an engagement force F2, F3 of the grippers 160*a*, 160*c*, respectively, can be increased by the pressure in the hydraulic control lines L2, L3 self-intensifying due to the larger force F1 being applied to the portion of the tubular joint by the actuator 200. In operation 310, the rotation of the portion of the tubular joint 56 can be completed with minimal slippage due to the self-intensifying actuators 140, 150. In operation 312, the actuators 140, 150, 200 can be disengaged from the tubular joint 56 to release the tubular joint 56 from the wrench 130.

VARIOUS EMBODIMENTS

Embodiment 1. A system for torquing or untorquing a tool joint, the system comprising:

a wrench with multiple actuators configured to engage a portion of a tubular joint when the multiple actuators are extended, and a first actuator of the multiple actuators being configured to intensify a first engagement force applied to the portion of the tubular joint in response to slippage between at least one of the multiple actuators and the portion of the tubular joint.

Embodiment 2. The system of embodiment 1, wherein the multiple actuators comprise a second actuator that is configured to intensify a second engagement force applied to the portion of the tubular joint in response to slippage between either one of the first actuator or the second actuator, and the portion of the tubular joint.

Embodiment 3. The system of embodiment 2, wherein the multiple actuators comprise a third actuator that is configured to apply a third engagement force to the portion of the tubular joint, and wherein the third engagement force is greater than either one of the first engagement force or the second engagement force.

Embodiment 4. The system of embodiment 3, further comprising a pressure equalizer that substantially equalizes a first pressure to a second pressure, wherein the first pressure is applied to the first actuator and the second pressure is applied to the second actuator.

Embodiment 5. The system of embodiment 4, wherein the pressure equalizer substantially equally increases the first pressure and the second pressure in response to the slippage of either one of the first actuator or the second actuator.

Embodiment 6. The system of embodiment 5, wherein a valve selectively blocks fluid from flowing away from the pressure equalizer, such that the fluid is trapped in the equalizer, the first actuator, and the second actuator, and the trapped fluid causes the first pressure and the second pressure to increase in response to the slippage of either one of the first actuator or the second actuator.

Embodiment 7. The system of embodiment 3, wherein the first actuator, the second actuator, and the third actuator are circumferentially spaced away from each other about a center axis of the wrench.

Embodiment 8. The system of embodiment 7, wherein the first actuator and the second actuator are circumferentially spaced away from the third actuator by an arc distance.

Embodiment 9. The system of embodiment 8, wherein the arc distance ranges from 110 degrees up to 160 degrees.

Embodiment 10. The system of embodiment 8, wherein the first actuator comprises a first gripper, the second actuator comprises a second gripper, and the third actuator comprises a third gripper, and wherein the first gripper and the second gripper are circumferentially spaced away from the third gripper by the arc distance.

Embodiment 11. The system of embodiment 10, wherein the first actuator is coupled to the first gripper via a first pivot arm, and wherein extension of the first actuator rotates the first pivot arm towards a center axis of the wrench and retraction of the first actuator rotates the first pivot arm away from the center axis.

Embodiment 12. The system of embodiment 11, wherein the second actuator is coupled to the second gripper via a second pivot arm, and wherein extension of the second actuator rotates the second pivot arm towards a center axis of the wrench and retraction of the second actuator rotates the second pivot arm away from the center axis.

Embodiment 13. The system of embodiment 1, wherein the wrench is configured to rotate at least a portion of the tubular joint about a center axis of the wrench when the multiple actuators are engaged with the portion of the tubular joint.

Embodiment 14. The system of embodiment 1, wherein the wrench is configured to prevent rotation of the at least a portion of the tubular joint about a center axis of the tubular joint when the multiple actuators are engaged with the portion of the tubular joint.

Embodiment 15. A system for torquing or untorquing a tool joint, the system comprising:

a wrench with multiple actuators configured to engage a tubular joint when the multiple actuators are extended, the multiple actuators comprise a first actuator, a second actuator, and a third actuator;

a pressure equalizer that substantially equalizes a first pressure applied to the first actuator to a second pressure applied to the second actuator; and a flow control device that is configured to substantially equally increase the first pressure and the second pressure when either one of the first actuator or the second actuator slips relative to the tubular joint.

Embodiment 16. The system of embodiment 15, wherein the first actuator is configured to apply a first engagement force to the tubular joint based on the first pressure, wherein the second actuator is configured to apply a second engagement force to the tubular joint based on the second pressure; and wherein the third actuator is configured to apply a third engagement force to the tubular joint based on a third pressure, and wherein the first engagement force is substantially equal to the second engagement force and both of the first engagement force and the second engagement force are less that the third engagement force.

Embodiment 17. The system of embodiment 16, wherein the third engagement force pushes against the tubular joint in opposition to the first engagement force and the second engagement force, wherein when either one of the first actuator or the second actuator slips relative to the tubular joint, the third engagement force, being higher that either one of the first engagement force and the second engagement force, forces the first actuator and the second actuator to increase the respective first engagement force and the second engagement force, since supply pressure to the first actuator and the second actuator is trapped by a one-way valve.

Embodiment 18. The system of embodiment 16, wherein the first engagement force and the second engagement force are increased when either one of the first actuator or the second actuator slips relative to the tubular joint.

Embodiment 19. The system of embodiment 18, wherein the increased first engagement force and the increased second engagement force are both less than the third engagement force.

Embodiment 20. The system of embodiment 15, wherein the flow control device comprises a control valve and a check valve that are coupled in parallel with each other.

Embodiment 21. The system of embodiment 20, wherein the flow control device blocks flow through the control valve to the pressure equalizer when pressure is supplied to the flow control device and the check valve allows flow to the pressure equalizer when pressure is supplied to the flow control device.

Embodiment 22. The system of embodiment 21, wherein the check valve prevents flow from the pressure equalizer when pressure is supplied to the flow control device, thereby intensifying pressure to the first actuator and the second actuator when either one of the first actuator or the second actuator slips relative to the tubular joint.

Embodiment 23. The system of embodiment 20, wherein the control valve allows flow from the pressure equalizer when pressure supplied to the flow control device is substantially removed.

Embodiment 24. A system for torquing or untorquing a tool joint, the system comprising:

a torque wrench with multiple actuators configured to engage a tubular joint when the multiple actuators are extended, the torque wrench being configured to rotate at least a portion of the tubular joint about a center axis when engaged with the portion of the tubular joint, and at least one of the multiple actuators being configured to intensify an engagement force applied to the portion of the tubular joint in response to slippage between at least one of the multiple actuators and the portion of the tubular joint.

Embodiment 25. The system of embodiment 24, further comprising a force equalizer that ensures that a first actuator and a second actuator of the multiple actuators apply a substantially equal first engagement force when the first actuator and the second actuator are extended.

Embodiment 26. The system of embodiment 25, wherein a third actuator of the multiple actuators applies a second engagement force when the third actuator is extended, and wherein the second engagement force is higher than the first engagement force.

Embodiment 27. The system of embodiment 26, wherein the first engagement force is increased in response to slippage between the first actuator or the second actuator.

Embodiment 28. The system of embodiment 27, wherein the increased first engagement force remains lower than the second engagement force.

Embodiment 29. The system of embodiment 25, wherein the force equalizer comprises hydraulic control circuitry that substantially equalizes a first pressure supplied to the first actuator and a second pressure supplied to the second actuator.

Embodiment 30. The system of embodiment 25, wherein hydraulic circuitry is configured to supply equalized pressure to input ports of the first actuator and the second actuator and trap the equalized pressure at the input ports.

Embodiment 31. The system of embodiment 30, wherein the equalized pressure is increased in response to the slippage, and wherein a check valve in the hydraulic circuitry prevents hydraulic fluid to flow away from the input ports, when the first actuator and the second actuator are extended.

Embodiment 32. The system of embodiment 24, wherein the multiple actuators are circumferentially spaced around the center axis of the torque wrench.

Embodiment 33. The system of embodiment 32, wherein the multiple actuators comprise a first actuator, a second actuator, and a third actuator, and wherein the first actuator and the second actuator are circumferentially spaced away from the third actuator by an arc distance.

Embodiment 34. The system of embodiment 33, wherein the arc distance ranges from 110 degrees up to 160 degrees.

Embodiment 35. A system for torquing or untorquing a tool joint, the system comprising:

a torque wrench with a first set of actuators configured to engage a pin end of a tubular joint when the first set of actuators are extended, the torque wrench being configured to rotate the pin end about a center axis of the torque wrench when engaged with the pin end; and a backup tong with a second set of actuators configured to engage a box end of the tubular joint when the second set of actuators are extended, the backup tong being configured to prevent rotation of the box end about the center axis when the second set of actuators are engaged with the box end, wherein a first actuator of the second set of actuators is configured to intensify a first engagement force applied to the box end when one of the second set of actuators slips relative to the box end.

Embodiment 36. The system of embodiment 35, wherein the second set of multiple actuators comprises a second actuator that is configured to intensify a second engagement force applied to the box end in response to slippage between either one of the first actuator or the second actuator and the box end.

Embodiment 37. The system of embodiment 36, wherein the second set of multiple actuators comprises a third actuator that is configured to apply a third engagement force to the box end, and wherein the third engagement force is greater than either one of the first engagement force or the second engagement force.

Embodiment 38. The system of embodiment 37, further comprising a pressure equalizer that substantially equalizes a first pressure and a second pressure, wherein the first pressure is applied to the first actuator and the second pressure is applied to the second actuator.

Embodiment 39. The system of embodiment 38, wherein the pressure equalizer substantially equally increases the first pressure and the second pressure in response to the slippage of either one of the first actuator or the second actuator.

Embodiment 40. The system of embodiment 39, wherein a valve selectively blocks fluid from flowing away from the pressure equalizer, such that the fluid is trapped in the equalizer, the first actuator, and the second actuator, and the trapped fluid causes the first pressure and the second pressure to increase in response to the slippage of either one of the first actuator or the second actuator.

Embodiment 41. The system of embodiment 37, wherein the first actuator, the second actuator, and the third actuator are circumferentially spaced away from each other about the center axis.

Embodiment 42. The system of embodiment 41, wherein the first actuator and the second actuator are circumferentially spaced away from the third actuator by an arc distance.

Embodiment 43. The system of embodiment 42, wherein the arc distance ranges from 110 degrees up to 160 degrees.

Embodiment 44. The system of embodiment 42, wherein the first actuator comprises a first gripper, the second actuator comprises a second gripper, and the third actuator comprises a third gripper, and wherein the first gripper and the second gripper are circumferentially spaced away from the third actuator by the arc distance.

Embodiment 45. The system of embodiment 44, wherein the first actuator is coupled to the first gripper via a first pivot arm, and wherein extension of the first actuator rotates the first pivot arm towards the center axis and retraction of the first actuator rotates the first pivot arm away from the center axis.

Embodiment 46. The system of embodiment 45, wherein the second actuator is coupled to the second gripper via a second pivot arm, and wherein extension of the second actuator rotates the second pivot arm towards the center axis and retraction of the second actuator rotates the second pivot arm away from the center axis.

Embodiment 47. The system of embodiment 35, wherein the backup tong is configured to prevent rotation of the box end about the center axis when the second set of multiple actuators is engaged with the box end.

Embodiment 48. A method for torquing or untorquing a tool joint, the method comprising:

engaging a portion of a tubular joint with a plurality of actuators;

applying a first engagement force to the portion of the tubular joint via a first actuator of the plurality of actuators; and intensifying the first engagement force in response to slippage between at least one of the plurality of actuators and the portion of the tubular joint.

Embodiment 49. The method of embodiment 48, further comprising:

applying a second engagement force to the portion of the tubular joint via a second actuator of the plurality of actuators; and intensifying the second engagement force in response to slippage between either one of the first actuator or the second actuator, and the portion of the tubular joint.

Embodiment 50. The method of embodiment 49, further comprising applying a third engagement force to the portion of the tubular joint via a third actuator of the plurality of actuators, and wherein the third engagement force is greater than either one of the first engagement force or the second engagement force.

Embodiment 51. The method of embodiment 50, further comprising equalizing, via a pressure equalizer, a first pressure applied to the first actuator with a second pressure applied to the second actuator.

Embodiment 52. The method of embodiment 51, further comprising:

substantially equally increasing the first pressure and the second pressure in response to the slippage of either one of the first actuator or the second actuator.

Embodiment 53. The method of embodiment 52, further comprising:

blocking, via a valve, fluid flow away from the pressure equalizer, thereby trapping fluid in the equalizer, the first actuator, and the second actuator; and increasing the first pressure and the second pressure in response to the slippage of either one of the first actuator or the second actuator and the trapped fluid.

Embodiment 54. The method of embodiment 50, further comprising circumferentially spacing the plurality of actuators about a center axis.

Embodiment 55. The method of embodiment 50, further comprising circumferentially spacing the first actuator and the second actuator away from the third actuator by an arc distance about a center axis.

Embodiment 56. The method of embodiment 55, wherein the arc distance ranges from 110 degrees up to 160 degrees.

Embodiment 57. The method of embodiment 55, wherein the first actuator comprises a first gripper, the second actuator comprises a second gripper, and the third actuator comprises a third gripper, and wherein the first gripper and the second gripper are circumferentially spaced away from the third gripper by the arc distance.

Embodiment 58. The method of embodiment 57, wherein the first actuator is coupled to the first gripper via a first pivot arm, and wherein extending the first actuator rotates the first pivot arm towards the center axis and retracting the first actuator rotates the first pivot arm away from the center axis.

Embodiment 59. The method of embodiment 58, wherein the second actuator is coupled to the second gripper via a second pivot arm, and wherein extending of the second actuator rotates the second pivot arm towards the center axis and retracting of the second actuator rotates the second pivot arm away from the center axis.

Embodiment 60. The method of embodiment 48, wherein a wrench comprises the plurality of actuators, and wherein the wrench is configured to rotate at least a portion of the tubular joint about a center axis of the wrench when the plurality of actuators are engaged with the portion of the tubular joint.

Embodiment 61. The method of embodiment 48, wherein a wrench comprises the plurality of actuators, and wherein the wrench is configured to prevent rotation of the at least a portion of the tubular joint about a center axis of the tubular joint when the plurality of actuators are engaged with the portion of the tubular joint.

Embodiment 62. A system for torquing or untorquing a tool joint, the system comprising:

a wrench with multiple actuators configured to engage a portion of a tubular joint when the multiple actuators are extended, and a first actuator of the multiple actuators being configured to intensify a first engagement force applied to the portion of the tubular joint in response to slippage between at least one of the multiple actuators and the portion of the tubular joint.

Embodiment 63. A system for torquing or untorquing a tool joint, the system comprising:

a torque wrench with multiple actuators configured to engage a tubular joint when the multiple actuators are extended, the torque wrench being configured to rotate at least a portion of the tubular joint about a center axis of the torque wrench when the multiple actuators are engaged with the portion of the tubular joint, and a first actuator of the multiple actuators being configured to apply a first engagement force to the portion of the tubular joint when it is extended and apply a second engagement force to the portion of the tubular joint when at least one of the multiple actuators slips relative to the portion of the tubular joint.

Embodiment 64. The system of embodiment 63, wherein the second engagement force is greater than the first engagement force.

Embodiment 65. A system for torquing or untorquing a tool joint, the system comprising:

a torque wrench with multiple actuators circumferentially spaced around a center axis of the torque wrench, wherein the multiple actuators are configured to engage a tubular joint when the multiple actuators are extended, wherein the torque wrench is configured to rotate about the center axis and rotate at least a portion of the tubular joint about the center axis, and wherein at least one of the multiple actuators is configured to intensify an engagement force applied to the portion of the tubular joint when at least one of the multiple actuators slips relative to the portion of the tubular joint.

Embodiment 66. The system of embodiment 65, further comprising a wrench assembly that comprises the torque wrench and a backup tong.

Embodiment 67. The system of embodiment 66, wherein one of the multiple actuators is configured to apply a first engagement force to the portion of the tubular joint.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A system for torquing or untorquing a tool joint, the system comprising:

a wrench with multiple actuators configured to engage a portion of a tubular joint when the multiple actuators are extended, and a first actuator of the multiple actuators being configured to intensify a first engagement force applied to the portion of the tubular joint in response to slippage between at least one of the multiple actuators and the portion of the tubular joint.

2. The system of claim 1, wherein the multiple actuators comprise a second actuator that is configured to intensify a second engagement force applied to the portion of the tubular joint in response to slippage between either one of the first actuator or the second actuator, and the portion of the tubular joint.

3. The system of claim 2, wherein the multiple actuators comprise a third actuator that is configured to apply a third engagement force to the portion of the tubular joint, and wherein the third engagement force is greater than either one of the first engagement force or the second engagement force.

4. The system of claim 3, further comprising a pressure equalizer that substantially equalizes a first pressure to a second pressure, wherein the first pressure is applied to the first actuator and the second pressure is applied to the second actuator.

5. The system of claim 4, wherein the pressure equalizer substantially equally increases the first pressure and the second pressure in response to the slippage of either one of the first actuator or the second actuator.

6. The system of claim 4, wherein a valve selectively blocks fluid from flowing away from the pressure equalizer, such that the fluid is trapped in the pressure equalizer, the first actuator, and the second actuator, and the trapped fluid causes the first pressure and the second pressure to increase in response to the slippage of either one of the first actuator or the second actuator.

7. A system for torquing or untorquing a tool joint, the system comprising:

a torque wrench with multiple actuators configured to engage a tubular joint when the multiple actuators are extended, the torque wrench being configured to rotate at least a portion of the tubular joint about a center axis when engaged with the portion of the tubular joint, and at least one of the multiple actuators being configured to intensify an engagement force applied to the portion of the tubular joint in response to slippage between at least one of the multiple actuators and the portion of the tubular joint.

8. The system of claim 7, further comprising a force equalizer that ensures that a first actuator and a second actuator of the multiple actuators each apply a first engagement force when the first actuator and the second actuator are extended.

9. The system of claim 8, wherein a third actuator of the multiple actuators applies a second engagement force when the third actuator is extended, and wherein the second engagement force is higher than the first engagement force.

10. The system of claim 9, wherein the first engagement force is increased in response to slippage between the first actuator or the second actuator, and wherein the increased first engagement force remains lower than the second engagement force.

11. The system of claim 8, wherein hydraulic circuitry is configured to supply equalized pressure to input ports of the first actuator and the second actuator and trap the equalized pressure at the input ports, and wherein the equalized pressure is increased in response to the slippage, and wherein a check valve in the hydraulic circuitry prevents hydraulic fluid to flow away from the input ports, when the first actuator and the second actuator are extended.

12. The system of claim 7, wherein the multiple actuators comprise a first actuator, a second actuator, and a third actuator, and wherein the first actuator and the second actuator are circumferentially spaced away from the third actuator by an arc distance.

13. The system of claim 12, wherein the arc distance is selected from a range of arc distances from 110 degrees up to 160 degrees.

14. A method for torquing or untorquing a tool joint, the method comprising:

engaging a portion of a tubular joint with a plurality of actuators;

applying a first engagement force to the portion of the tubular joint via a first actuator of the plurality of actuators; and intensifying the first engagement force in response to slippage between at least one of the plurality of actuators and the portion of the tubular joint.

15. The method of claim 14, further comprising:

applying a second engagement force to the portion of the tubular joint via a second actuator of the plurality of actuators; and intensifying the second engagement force in response to slippage between either one of the first actuator or the second actuator, and the portion of the tubular joint.

16. The method of claim 15, further comprising applying a third engagement force to the portion of the tubular joint via a third actuator of the plurality of actuators, and wherein the third engagement force is greater than either one of the first engagement force or the second engagement force.

17. The method of claim 16, further comprising equalizing, via a pressure equalizer, a first pressure applied to the first actuator with a second pressure applied to the second actuator.

18. The method of claim 17, further comprising:

substantially equally increasing the first pressure and the second pressure in response to the slippage of either one of the first actuator or the second actuator.

19. The method of claim 18, further comprising:

blocking, via a valve, fluid flow away from the pressure equalizer, thereby trapping fluid in the pressure equalizer, the first actuator, and the second actuator; and increasing the first pressure and the second pressure in response to the slippage of either one of the first actuator or the second actuator and the trapped fluid.

20. The method of claim 16, further comprising circumferentially spacing the first actuator and the second actuator away from the third actuator by an arc distance about a center axis, wherein the arc distance is selected from a range of arc distances from 110 degrees up to 160 degrees.

* * * * *